US006207339B1

(12) United States Patent
Kato et al.

(10) Patent No.: US 6,207,339 B1
(45) Date of Patent: Mar. 27, 2001

(54) PROCESS FOR PRODUCING TONER

(75) Inventors: Masayoshi Kato, Iruma; Hitoshi Kanda, Yokohama; Tatsuya Nakamura, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/377,517

(22) Filed: Aug. 19, 1999

(30) Foreign Application Priority Data

Aug. 25, 1998 (JP) ..... 10-238056
Oct. 27, 1998 (JP) ..... 10-304816

(51) Int. Cl.[7] ..... G03G 9/087
(52) U.S. Cl. ..... 430/137; 430/138
(58) Field of Search ..... 430/137, 138

(56) References Cited

U.S. PATENT DOCUMENTS

| | | | | |
|---|---|---|---|---|
| 5,153,092 | | 10/1992 | Kao et al. | 430/137 |
| 5,354,640 | | 10/1994 | Kanbayashi et al. | 430/110 |
| 5,418,109 | * | 5/1995 | Kanakura et al. | 430/137 |
| 5,622,802 | * | 4/1997 | Demizu et al. | 430/137 |
| 5,885,743 | * | 3/1999 | Takayanagi et al. | 430/137 |

FOREIGN PATENT DOCUMENTS

| | | |
|---|---|---|
| 0 621 511 | 10/1994 | (EP) . |
| 0 651 292 | 5/1995 | (EP) . |
| 36-10231 | 7/1961 | (JP) . |
| 43-10799 | 5/1968 | (JP) . |
| 51-14895 | 5/1976 | (JP) . |
| 59-053856 | 3/1984 | (JP) . |
| 59-061842 | 4/1984 | (JP) . |
| 63-124055 | 5/1988 | (JP) . |
| 4-311966 | 11/1992 | (JP) . |
| 6-324517 | 11/1994 | (JP) . |
| 7-092736 | 4/1995 | (JP) . |
| 8-160662 | 6/1996 | (JP) . |
| 8-179562 | 7/1996 | (JP) . |

* cited by examiner

*Primary Examiner*—John Goodrow
(74) *Attorney, Agent, or Firm*—Fitzpatrick, Cella, Harper & Scinto

(57) ABSTRACT

A process for producing a toner has the steps of, polymerizing a polymerizable monomer composition containing at least a polymerizable monomer and a colorant, in an aqueous dispersion medium to form colored polymer particles, and thereafter washing the colored polymer particles, followed by dewatering to prepare wet colored polymer particles, subjecting the resultant wet colored polymer particles to substantial removal of the water held by the wet colored polymer particles, by means of a dryer making use of hot air to obtain toner particles, and drying the toner particles under reduced pressure by means of a vacuum dryer so that polymerizable monomers remaining in the toner particles come to be in a residue of 200 ppm or less.

23 Claims, 5 Drawing Sheets

PROCESS FOR PRODUCING TONER

BACKGROUND OF THE INVENTION

1. Field of the Invention

This invention relates to a process for producing a toner used in a process for rendering latent images visible and a recording process of toner-jet system.

2. Related Background Art

A number of methods as disclosed in U.S. Pat. No. 2,297,691, etc. are known as electrophotography. In general, using a photoconductive material, copies are obtained by forming an electrostatic image on the photosensitive member by various means, subsequently developing the latent image by the use of a toner to form a toner image, transferring the toner image to a transfer medium such as paper as occasion calls, and thereafter fixing the toner image onto the transfer medium by the action of heat, pressure or solvent vapor. As methods for developing the latent image by the use of toners or methods for fixing the toner image, a variety of methods have been proposed, and methods suited for the respective image forming processes are employed.

Toners used for such purpose have commonly been produced by melt-kneading colorants comprising dyes and/or pigments, into thermoplastic resins to effect uniform dispersion, followed by pulverization using a fine grinding mill, and the pulverized product is classified using a classifier to produce toners having the desired particle diameters.

Reasonably good toners can be produced by such a production method, but there is a certain limit, i.e., a limit to the range in which toner materials are selected. For example, colorant-dispersed resin compositions must be brittle enough to be pulverizable with ease by means of an economically feasible production apparatus. However, such colorant-dispersed resin compositions made brittle in order to meet these requirements tend to result in a broad particle size distribution of the particles formed when actually pulverized at a high speed, particularly causing a problem in that fine particles tend to become included in the particles in a relatively large proportion. Moreover, toners obtained from such highly brittle materials tend to be further pulverized or powdered when used for development in copying machines. Also, in this method, it is difficult to uniformly disperse solid fine particles of colorants or the like in the resin, and some toners cause an increase in fog, a decrease in image density and a lowering of color mixing properties or transparency of toners at the time of image formation, depending on the degree of dispersion. Accordingly, care must be taken when colorants are dispersed. Also, colorants may separate and cause rupture sections of pulverized particles, and may cause fluctuations in developing performance of toners.

Meanwhile, in order to overcome the problems of the toners produced by such pulverization, toners produced by suspension polymerization are proposed as disclosed in Japanese Patent Publication No. 36-10231, No. 43-10799 and No. 51-14895. In the process for producing toners by suspension polymerization, a polymerizable monomer, a colorant and a polymerization initiator, and also optionally a cross-linking agent, a charge control agent and other additives are uniformly dissolved or dispersed to form a polymerizable monomer composition. Thereafter, this polymerizable monomer composition is dispersed in a continuous phase, e.g., an aqueous medium, containing a dispersion stabilizer, by means of a suitable stirrer and is simultaneously subjected to polymerization to obtain toner particles having the desired particle diameters.

Since this method has no step of pulverization, the toner particles are not required to be brittle, and hence soft materials can be used, and also the step of classification can be omitted, bringing about a great cost reduction effect such as energy saving, time reduction and improvement in process yield.

Toners themselves are also required to be made multifunctional because of copying machines and printers being made in recent years to have a high quality image, to enable full-color formation and to enjoy energy saving. For example, accompanying the achievement of high image quality, it is required to make toner particles have very small particle diameter so as to be adaptable to high-resolution digital systems. Accompanying the achievement of full-color formation, it is desired to improve transparency of OHP images; and accompanying the achievement of energy saving, it is desired to make a shape of toner particles that is effective for incorporating low-softening substances in toners and for improving transfer efficiency to transfer materials so as to be adaptable to low-temperature fixing. As a means for satisfying such requirement, toners produced by polymerization are used.

Meanwhile, suspension polymerization, including toners produced by suspension polymerization, react such that the polymerization causes increases in viscosity. Such increases, which are magnified as polymerization progresses make it difficult for radicals and polymerizable monomers to move, and hence polymerizable monomer components tend to remain in a large quantity. Especially in the case of suspension polymerization toners, components having a possibility of restraining the polymerization reaction, such as dyes, pigments (in particular, carbon black), charge control agents and magnetic materials are typically present in the polymerizable monomer system in relatively large amounts in addition to the polymerizable monomers, and hence more unreacted polymerizable monomers tend to remain.

If components acting as solvents for not only polymerizable monomers, but also binder resins are present in the resulting toner particles in a large quantity, the resulting toners have a low fluidity to make image quality poor and also cause a reduction in blocking resistance. Besides the performances correlating directly with toners, such components may also cause, in addition to the phenomenon of adhesion of toner to photosensitive member (drum), a problem exhibited during deterioration of a photosensitive member, namely memory ghost and faint images, especially when organic materials are used in the photosensitive member. Further, there is a problem that the polymerizable monomer components volatilize at the time of fixing to cause a bad smell.

In order to solve such problems, it is proposed, as disclosed in Japanese Patent Application Laid-Open No. 7-92736, to reduce polymerizable monomers present in toner particles to a residue of 500 ppm or less so that image quality can be improved.

With miniaturization and personal use of copying machines, printers and so forth, the restrictions on apparatus increases; the burden to solve the above problems increases and the concern for environment is greater. Thus, the polymerizable monomers should preferably be made present in toner particles in a residue of 200 ppm or less, and more preferably in a residue of 100 ppm or less.

As a method for providing the polymerizable monomers present in toner particles in a residue of 200 ppm or less, a known means for accelerating the consumption of polymerizable monomers may be used when binder resins are produced by suspension polymerization. For example, as methods for removing unreacted polymerizable monomers, there is a method in which toner particles are washed with a highly volatile organic solvent not capable of dissolving toner binder resins but capable of dissolving polymerizable monomers and/or organic solvent components; a method in which they are washed with an acid or alkali; a method in which a foaming agent and a solvent component not capable of dissolving polymers are put into the polymer system and the resulting toner particles are made porous so that the area for the inner polymerizable monomers and/or organic solvent components to evaporate can be larger; and a method in which polymerizable monomers and/or organic solvent components are evaporated under drying conditions. The method in which polymerizable monomers and/or organic solvent components are evaporated under drying conditions is most preferred because in other methods the toner constituent components may dissolve out because of their poor encapsulation in toner particles and it is difficult to select solvents taking into account the undesired retention of the solvents in the toner.

Improvements have been made on drying toner particles after suspensions, formed upon completion of polymerization reaction, have been solid-liquid separated. For example, Japanese Patent Application Laid-Open No. 63-124055 discloses a method of drying toner particles while suspending them by gas to form a fluidized bed. Japanese Patent Application Laid-Open No. 4-311966 and No. 8-179562 also disclose a method of drying toner particles by means of a fluidized bed dryer.

The above method of drying toner particles by means of a fluidized bed dryer can dry toner particles efficiently. Since, however, the unreacted polymerizable monomers stated above commonly have a higher boiling point than water, they can not effectively be removed unless the removal of water has almost been completed. Namely, they can not effectively be removed unless, upon lapse of a constant rate period of drying, the falling-rate drying has sufficiently taken place. However, once the water has been removed, particles having chargeability like the toner particles may adhere to fluidizing chamber wall surfaces, and the particles having adhered to the fluidizing chamber wall surfaces may further come off in masses, causing problems in that the unreacted polymerizable monomers are removed non-uniformly on the whole and the toner particles are formed in a low yield.

Japanese Patent Application Laid-Open No. 6-324517 also discloses a method of instantaneously drying toner particles after a suspension formed upon completion of polymerization reaction has been solid-liquid separated or while dispersing the suspension as it is, in the form of powder particles in a hot air stream so as to be carried in parallel to the hot air stream.

This method of drying toner particles by a hot air stream enables removal of water efficiently and continuously. However, the unreacted polymerizable monomers stated above can not be substantially removed by instantaneous drying.

Japanese Patent Application Laid-Open No. 8-160662 discloses a method of drying toner particles by means of a vacuum dryer.

This drying method, however, not only requires a very long drying time in order to remove water by evaporation and thereafter further remove the unreacted polymerizable monomers but also, when the water is removed, the vacuum in the apparatus may cause toner particles to tighten and agglomerate to form a compressed state. This compressed state is formed significantly when the water content becomes 5% by weight or less, because of an abrupt increase in agglomerative force acting between particles which is caused by an increase in powder temperature. The formation of this compressed state causes toner particles to adhere or melt-adhere to, e.g., apparatus wall surfaces and agitating blades in the apparatus, so that the apparatus is inhibited from stable operation. Also, the agglomeration of toner particles causes powder lumps, so that external additives do not adhere uniformly to toner particle surfaces when externally added in a post-toner preparation step, to cause a problem in the performance required as developers.

SUMMARY OF THE INVENTION

An object of the present invention is to provide a process for producing a toner, having solved the problems discussed above.

More specifically, an object of the present invention is to provide a toner production process in which toner particles obtained directly by polymerization are dried in a good efficiency while removing unreacted polymerizable monomers uniformly.

Another object of the present invention is to provide a process for producing a toner which can form images with a high image quality, free of any faulty images otherwise caused by the remaining unreacted polymerizable monomers.

To achieve the above objects, the present invention provides a process for producing a toner, comprising the steps of;

polymerizing a polymerizable monomer composition containing at least a polymerizable monomer and a colorant, in an aqueous dispersion medium to form colored polymer particles, and thereafter washing the colored polymer particles, followed by dewatering to prepare wet colored polymer particles;

subjecting the resultant wet colored polymer particles to substantial removal of the water held by the wet colored polymer particles, by means of a dryer making use of hot air to obtain toner particles; and drying the toner particles under reduced pressure by means of a vacuum dryer so that polymerizable monomers remaining in the toner particles come to be in a residue of 200 ppm or less.

The present invention also provides a process for producing a toner, comprising the steps of;

polymerizing a polymerizable monomer composition containing at least a polymerizable monomer and a colorant, in an aqueous dispersion medium to form colored polymer particles, and thereafter washing the colored polymer particles to prepare a slurry containing wet colored polymer particles;

subjecting the slurry containing wet colored polymer particles to substantial removal of the water held therein, by means of a dryer making use of hot air to obtain toner particles; and drying the toner particles under reduced pressure by means of a vacuum dryer so that polymerizable monomers remaining in the toner particles come to be in a residue of 200 ppm or less.

DESCRIPTION OF THE PREFERRED EMBODIMENTS

Figure 1:
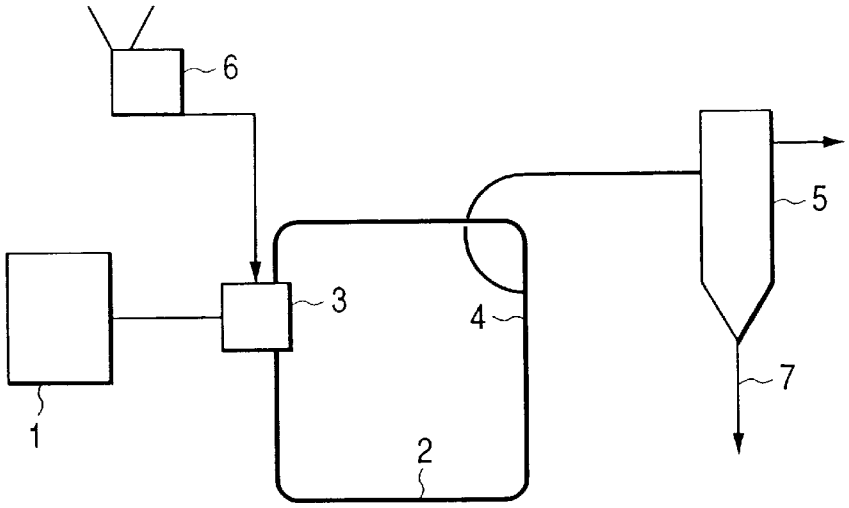
FIG. 1 is a schematic illustration showing an example of a system of an apparatus used in the present invention for instantaneously drying the drying target (wet particles or slurry) while dispersing it in the form of powder particles in a high-velocity hot air stream and forwarding them in parallel to the hot air stream.

As a result of extensive studies, the present inventors have discovered that a toner from which unreacted polymerizable monomers remaining in toner particles have been removed up to a residue of 200 ppm or less can be obtained in a good efficiency by subjecting wet colored polymer particles to removal of the aqueous dispersion medium by means of a dryer making use of hot air, followed by drying by means of a vacuum dryer.

In the case of the fluidized bed dryer used in the conventional polymerization toner production process, in order to remove unreacted polymerizable monomers up to a residue of 200 ppm or less, drying must be continued also after the water has been removed up to 0.1% by weight (as water content) and, as stated previously, once the water has been removed, particles having chargeability like the toner particles may adhere to fluidizing chamber wall surfaces, and the particles having adhered to the fluidizing chamber wall surfaces may further come off in masses, to cause problems that the unreacted polymerizable monomers are removed non-uniformly on the whole, resulting in a low performance as developers and a low operability.

In the case when toner particles are dried by vacuum drying from the beginning, it takes a very long time for the drying and also the powder lumps due to the agglomeration of toner particles may occur when the water is removed. Once the powder lumps have occurred, external additives do not adhere uniformly to toner particle surfaces when externally added in a post step, to cause a problem in the performance required as developers. Also, it is difficult to remove from the interior of agglomerate powder lumps the unreacted polymerizable monomers remaining in the particles, making toner particles non-uniform to cause the problems as stated above.

The present invention will be described below in greater detail.

In the toner production process of the present invention, wet colored polymer particles obtained by polymerizing a polymerizable monomer composition or a slurry containing the wet colored polymer particles is/are used as a drying target. When the former wet colored polymer particles are used as the drying target, such wet colored polymer particles having not dried may preferably have a water content of 40% by weight or less, and more preferably 30% by weight or less, in view of fluidity required as a powder. The "water content" herein referred to is meant to be water content by weight, i.e., the proportion of water weight based on the total weight (the sum of weight of dried toner particles and weight of water), and is determined by weight loss on heating at 105° C.

The toner particles having such a water content can readily be obtained by usual means of solid-liquid separation (e.g., filtration). In order to attain such a water content, toner particles may also be subjected to preliminary drying.

In the present invention, the drying target is dried first by means of a dryer making use of hot air. This step is a step aiming at substantial removal of the water held in the drying target. The drying target may preferably be dried until its water content comes to be from 0.1 to 0.5% by weight, and more preferably from 0.1 to 0.3% by weight. In the case when the drying target is dried so that its water content comes to be from 0.1 to 0.5% by weight, the particles can be kept from agglomerating and from adhering to wall surfaces of the dryer. Moreover, the time necessary for the step making use of a vacuum dryer, taken after this step, can be shortened to enable efficient production of toners.

As the dryer making use of hot air, usable are a dryer which dries wet particles while suspending them and forming a fluidized bed, and an apparatus which dries the drying target instantaneously while dispersing it in the form of powder particles in a high-velocity hot air stream and forwarding them in parallel to the hot air stream.

Figure 6:
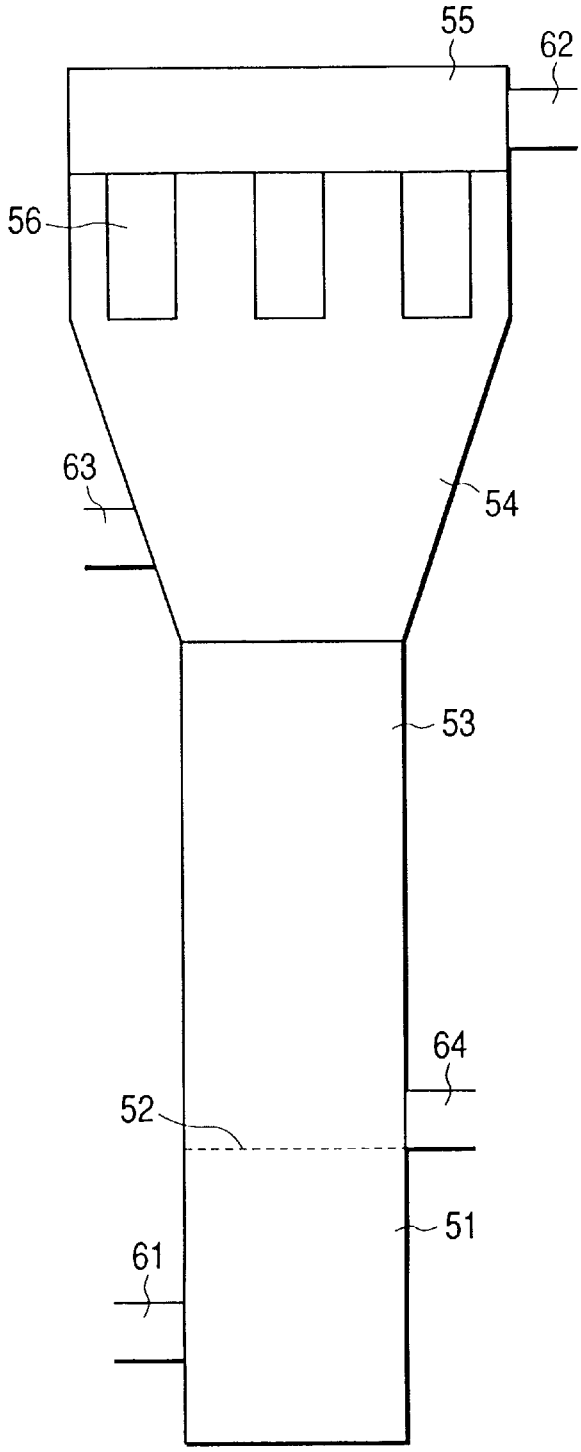
FIG. 6 is a diagrammatic view of a dryer for drying toner particles while forming a fluidized bed, used in the present invention.

The apparatus which dries wet particles while forming a fluidized bed may include an apparatus as shown in FIG. 6. The apparatus as shown in FIG. 6 has a cylindrical form on the whole, and is constituted of a fluidizing air blowing chamber 51 having a hot-air inlet 61, a grating plate 52 for rectifying a gas, upper and lower fluidizing chambers 53 and 54 in which a fluidized bed of particles and gas is formed, a filter 56 for capturing the particles, and an exhaust chamber 55 having an exhaust vent 62, which are provided along the gas flow path. The exhaust vent 62 is connected to an exhaust blower, through which the gas is drawn out.

The drying target is fed into the upper fluidizing chambers 54 through its feed opening 63 and a dried product is taken out through a take-out opening 64 of the lower fluidizing chamber 53.

The drying carried out using this drying apparatus is operated, e.g., in the following way: The drying target particles fed into the fluidizing chamber 54 are blown up by the hot air fed from the fluidizing air blowing chamber 51 and introduced via the grating plate 52, and are fluidized together with the gas. The drying target particles suspended inside the fluidizing chambers 53 and 54 to form a fluidized bed are uniformly mixed with the gas and are dried at the interior of this fluidized bed.

The drying target particles blown up into the upper fluidizing chamber 54 are captured by the filter 56, where, e.g., a back-wash pulse may be applied to this filter, thus the drying target particles are brushed off to return downward.

The apparatus which dries the drying target (slurry or wet particles) instantaneously while dispersing it in the form of powder particles in a high-velocity hot air stream and forwarding them in parallel to the hot air stream may include an airborne dryer having a loop type drying pipe 2 as shown in FIG. 1, but not particularly limited thereto.

In the airborne dryer shown in FIG. 1, compressed air heated to a prescribed temperature in a hot-air-stream generator 1 is jetted out at a supersonic speed at an air stream dispersion section 3 to disperse the drying target fed from a drying target feed unit 6. The drying target is dried in the loop type airborne drying pipe 2 instantaneously (in 0.5 to 10 seconds). A gas draw-out opening 4 is provided inside the loop type airborne drying pipe 2, whereby the drying target is classified into a dried product and an undried product by the Coanda effect, and the dried product is separated from the air stream by a cyclone 5 and can be taken out of the system through a take-out opening 7.

Coarse particles in the particles having come out of the drying pipe 2 may be separately classified by a classifier and may be returned to the drying target feed unit 6 so that only particles having particle size within a prescribed range are fed to the cyclone 5 to obtain the desired toner particles, whereby classification and drying can be carried out continuously. Incidentally, as the type of the drying pipe of the airborne dryer, in addition to the above loop type, any type of drying pipes may be used, including a straight pipe type, a type in which the middle barrel is enlarged in order to elongate the residence time, and a type in which swirl movement is imparted to particles to prevent them from depositing on the horizontal pipe bottom part. Particularly preferred is the airborne dryer having the loop type drying pipe as shown in FIG. 1.

In the apparatus which dries the drying target while forwarding it in parallel to high-velocity hot air stream, compressed air heated to 40 to 150° C., and preferably 60 to 120° C., may preferably be used as the hot air stream. Heated-air temperature lower than 40° C. may result in a low drying efficiency, and that higher than 150° C. may cause melt-adhesion of toner, thus such temperatures are not preferable.

The apparatus preferably used in the present invention which dries the drying target (slurry or wet particles) instantaneously while dispersing it in the form of powder particles in a high-velocity hot air stream and forwarding them in parallel to the hot air stream may specifically include Flash Jet dryer (manufactured by Seishin Kigyo K.K.) and Flash dryer (manufactured by Hosokawa Micron K.K.)

Figure 2:
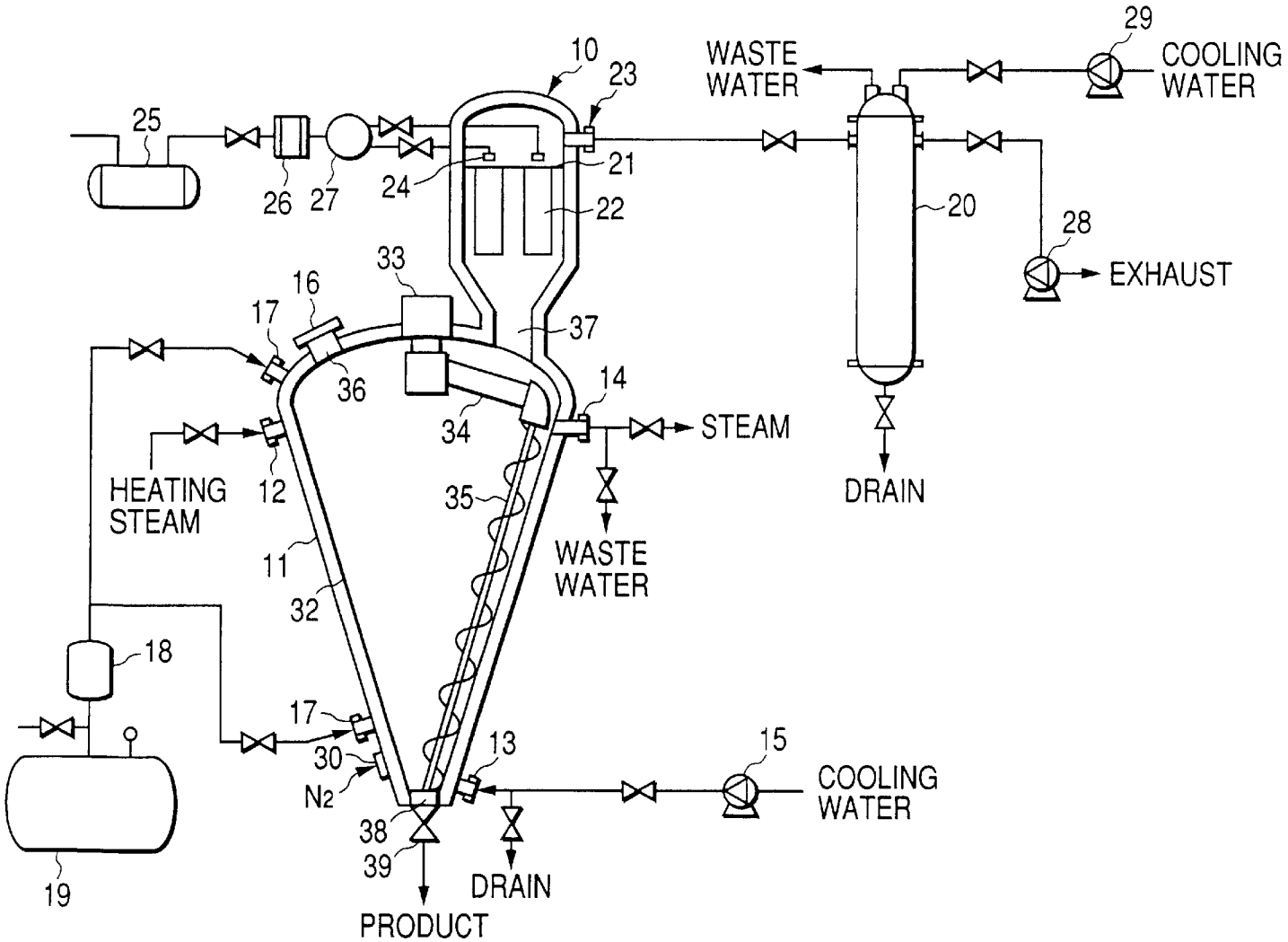
FIG. 2 is a cross-sectional view showing an example of a vacuum dryer used in the present invention and a system of the dryer.
Figure 3:
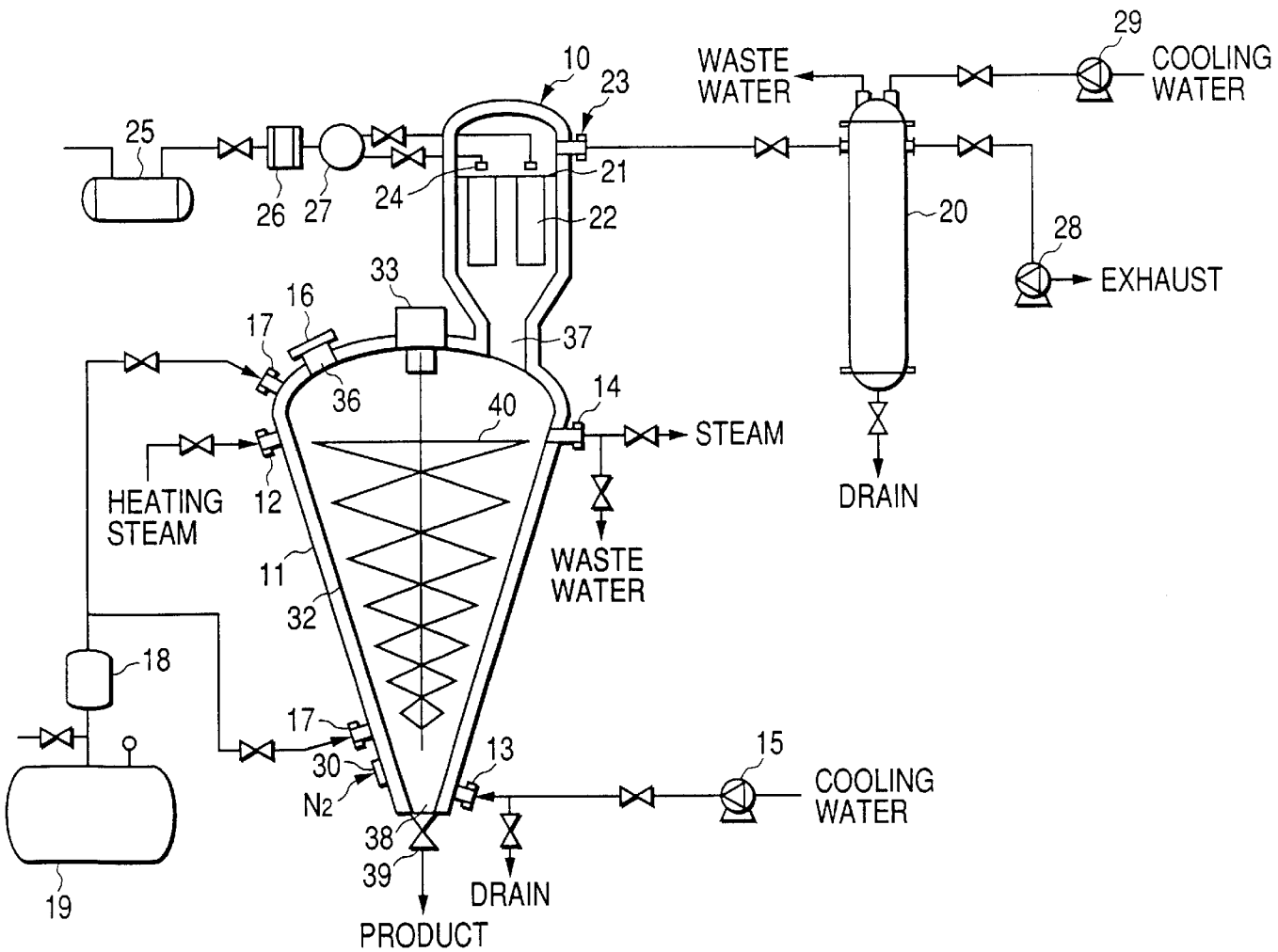
FIG. 3 is a cross-sectional view showing another example of a vacuum dryer used in the present invention and a system of the dryer.

As for the vacuum dryer used in the present invention, which is used after the aqueous dispersion medium has substantially been removed, any apparatus may be used without any particular limitations so long as it can dry colored polymer particles in the state of vacuum or reduced pressure. In the case when the polymer particles are dried using such an apparatus, polymerizable monomers remaining in the polymer particles can preferably be removed simultaneously with the water. For example, vacuum dryers embodied as shown in FIGS. 2 and 3 as diagrammatic side views may preferably be used. In such reduced pressure (vacuum drying, a high pressure results in less volatiles and a low drying efficiency. Accordingly, the drying may preferably be carried out at 13 kPa or below.

In the present invention, the polymerizable monomers remaining in toner particles may be in a residue of 200 ppm or less, preferably 150 ppm or less, and particularly preferably 100 ppm or less.

When the drying for removing such polymerizable monomers is carried out using the vacuum dryer alone, the agglomeration of particles comes into question as stated previously. However, in the present invention, the water held by the polymer particles has first been removed by the dryer making use of hot air, and hence the particles can be kept from agglomeration.

The vacuum dryers embodied as shown in FIGS. 2 and 3, which are of agitation type, are described below in detail.

In the dryer shown in FIG. 2, drying target particles are fed into a drying vessel 32 having the shape of an inverted cone and dried there. The drying vessel 32 is provided therein with a screw type agitation member 35 connected, via a drive arm 34, with a drive unit 33 disposed above the vessel 32, and is so set up that the agitation member 35 circles along the inner periphery of the vessel 32 while being rotated. Thus, in the dryer shown in FIG. 2, the drying target particles inside the vessel 32 are repeatedly agitated and dispersed while being brought upward from the lower part, and hence the drying target particles are agitated and mixed in a good efficiency throughout the interior of the vessel 32.

As shown in FIG. 2, the vessel 32 is also provided at the upper part thereof with a material feed opening 36 for feeding the drying target particles, and an exhaust vent 37 for drawing out the gas inside the vessel 32 when the inside of the vessel is evacuated and also when dried under reduced pressure while feeding the gas. Then, the material feed opening 36 is fitted with a hermetic cover 16, and a bag filter 10 is connected with the exhaust vent 37. At the lower part of the dryer, a take-out opening 38 for taking out a dried product is provided in the manner it is connected with a take-out valve 39. When the inside of the vessel 32 is evacuated, the gas inside the vessel 32 is drawn out by means of a vacuum pump 28 through the exhaust vent 37 via the bag filter 10 and a cold trap 20.

As shown in FIG. 2, around the drying vessel 32, a jacket 11 is also provided which can appropriately control the internal temperature of the drying vessel 32 so as to carry out the drying at the desired temperature. For this purpose, a gap is formed between the outer wall of the drying vessel 32 and the inner wall of the jacket 11, and the jacket 11 is provided with a steam feed opening 12, a cooling water feed opening 13 and a steam or cooling water discharge opening 14 so that heating steam or cooling water can be passed through the gap. Then, a steam generating boiler (not shown) is connected to the steam feed opening 12, and a cooling water pump 15 is connected to the cooling water feed opening 13.

The drying vessel 32 is also provided with steam injection openings 17 at the upper and lower two positions of the vessel 32, and is so set up that the materials can effectively be agitated with the injection of steam by feeding the steam in a large quantity from the lower-side steam injection opening 17. These steam injection openings 17 are both connected to a steam generating boiler 19 via an accumulator 18. This accumulator 18 is a means for feeding saturated or superheated steam quickly into the vessel 32, and is indispensable for completing the heating of materials in the vessel 32 in a short time and bringing the materials to an optimum drying temperature.

As stated previously, when the inside of the vessel 32 is evacuated, the gas inside the vessel 32 is drawn out by means of the vacuum pump 28 through the exhaust vent 37 via the bag filter 10 and the cold trap 20. As shown in FIG. 2, the inside of the bag filter 10 is partitioned by a partition plate 21 into upper and lower two chambers. Then, a cylindrical filter cloth 22 is hung from the partition plate 21 on its lower side. On the upper side of the partition plate 21, an exhaust vent 23 connected to the cold trap 20 and a washing nozzle 24 is provided at the center upper position of the filter cloth 22. The washing nozzle 24 is a means for intermittently jetting high-pressure air sent from a compressor 25, to wash the filter cloth 22 by back pressure. An accumulator 27 is also attached between a filter 26 and the washing nozzle 24. This accumulator 27 is provided so that any shortage of high-pressure air feed quantity on the side of the compressor 25 can be compensated to feed the high-pressure air in a constant quantity to the washing nozzle 24 in a stable state with less pressure variations, and also the flow rate and passing speed of the air passing through the filter 26 can be kept substantially constant to stabilize the effect of filtration by the filter 26.

When dried under reduced pressure while feeding a gas, the gas is fed into the drying vessel 32 from a gas introducing opening 30 provided at the lower part of the apparatus. The drying under reduced pressure while feeding a gas can keep toner particles from blocking, which tends to occur at the lower part in the apparatus, and also the gas acts as a carrier gas for evaporating deposited water or residual polymerizable monomers from the material particle surfaces in a good efficiency. Thus, in view of an improvement of efficiency, it is preferable to feed the gas.

The gas fed into the drying vessel 32 becomes a moistened gas containing the water and residual polymerizable monomers originating from material particles, and is drawn out of the back filter 10 via the exhaust vent 23. Then, the moistened gas thus drawn out is sent into the cold trap 20 and the liquid such as water formed by condensation is discharged as a drain from the cold trap 20. Meanwhile, the gas component is drawn outside by means of the vacuum pump 28 connected to the cold trap 20. To the cold trap 20, a pump 29 for sending cooling water is connected so that the moistened gas can be cooled to effect gas-liquid separation in a good efficiency.

As for the dryer shown in FIG. 3, it is so set up that a ribbon blade 40 of double-helical structure is rotatable by means of a drive unit 33 provided at the upper part of a drying vessel 32 having the shape of an inverted cone. As being set up in this way, the drying target inside the vessel 32 is repeatedly agitated and dispersed while being brought upward from the lower part, and hence the drying target is agitated and mixed in a good efficiency throughout the interior of the vessel 32. The construction of other constituents of the dryer shown in FIG. 3 is common to that of the vacuum dryer shown in FIG. 2, and the description on such constituents is omitted.

The vacuum dryer preferably used in the present invention, which is used after the aqueous dispersion medium has substantially been removed, may specifically include Nauta mixer (manufactured by Hosokawa Micron K.K.), Ribocone (manufactured by Ohkawara Seisakusho K.K.) and SV mixer (manufactured by Shinko Panteck K.K.).

As the toner produced by the present invention, a toner having a smaller particle diameter is preferred in order to develop more minute latent-image dots for the achievement of high image quality. Stated specifically, preferred is a toner having a weight-average particle diameter of from 4 to 8 $\mu$m and a coefficient of variation of number distribution of 35% or less, as measured with a Coulter counter.

A toner having a weight-average particle diameter smaller than 4 $\mu$m may remain on the photosensitive member or intermediate transfer member in a large quantity as transfer residual toner because of a poor transfer efficiency to cause uneven images due to fog and faulty transfer, and is not preferable as the toner in the present invention. A toner having a weight-average particle diameter larger than 8 $\mu$m tends to cause its melt-adhesion to members, and this tends greatly when the coefficient of variation of number distribution of the toner is more than 35%.

The coefficient of variation of number distribution of the toner is calculated according to the following expression.

Coefficient of variation, (%)={(standard deviation of number distribution)/(number average particle diameter)}×100

In the toner production process of the present invention, the suspension polymerization disclosed in Japanese Patent Publication No. 36-10231 and Japanese Patent Application Laid-Open No. 59-53856 and No. 59-61842 may be used.

In the present invention, what is called seed polymerization may also preferably be used in which monomers are additionally adsorbed on polymer particles once obtained, and thereafter polymerized using a polymerization initiator.

In the present invention, from the viewpoint of fixing performance, it is necessary for the toner particles to be incorporated with a low-softening substance in a large quantity, and hence it is inevitably necessary to encapsulate the low-softening substance in shell resin. As a specific method by which the low-softening substance is encapsulated, a low-softening substance whose material polarity in an aqueous medium is smaller than the main polymerizable monomer may be used and also a small amount of resin or polymerizable monomer with a greater polarity than the main monomer may be added. Thus, toner particles having a core/shell structure wherein the low-softening substance is covered with the shell resin can be obtained. The particle size distribution and particle diameter of the toner particles may be controlled by a method in which the types and amounts of a slightly water-soluble inorganic salt and a dispersant having the action of protective colloids are changed, or by changing mechanical apparatus conditions, e.g., the conditions for agitation, such as the peripheral speed of a rotor, pass times and the shape of agitating blades, the shape of the reaction vessel, or the concentration of solid matter in the aqueous medium.

Figure 5:
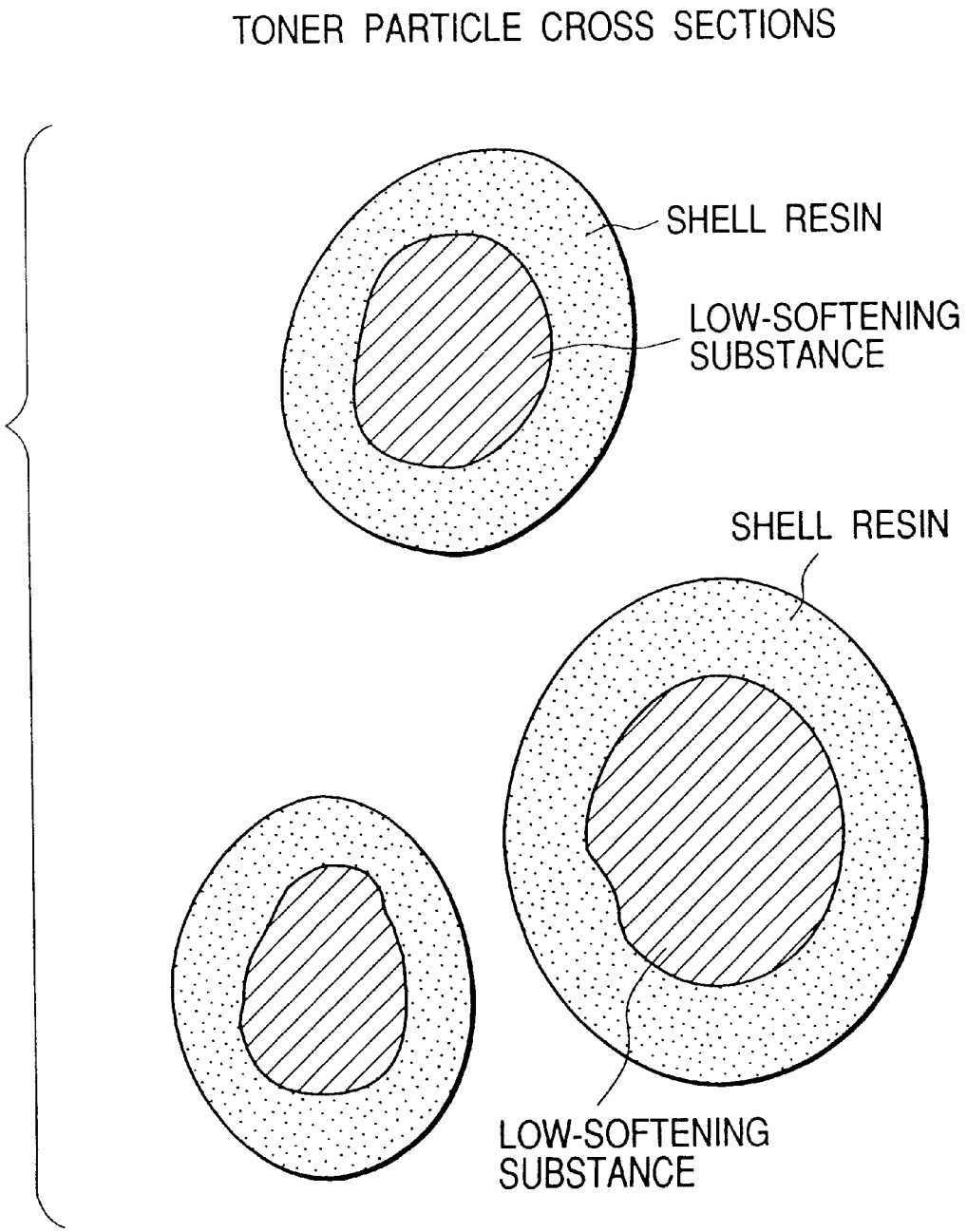
FIG. 5 is a diagrammatic view showing cross sections of toner particles encapsulated with a low-softening substance.

Whether or not the toner particles have he core/shell structure can be ascertained by observing cross sections of toner particles. Stated specifically, the cross sections of toner particles can be observed in the following way. Toner particles are well dispersed in a room temperature curing epoxy resin, followed by curing in an environment of temperature 40° C. for 2 days, and the cured product obtained is dyed with triruthenium tetraoxide optionally in combination with triosmium tetraoxide. Thereafter, samples are cut out in slices by means of a microtome having a diamond cutter to observe the cross sections of toner particles using a transmission electron microscope (TEM). In the present invention, it is preferable to use the triruthenium tetraoxide dyeing method in order to form a contrast between the materials by utilizing some difference in crystallinity between the low-softening substance used and the resin constituting the shell. A typical example is shown in FIG. 5. It has been observed that toner particles produced in Examples given later have the structure wherein the low-softening substance is clearly encapsulated with the shell resin.

As the polymerizable monomer usable in the polymerization toner, it is preferable to use styrene monomers such as styrene, o-, m- or p-methylstyrene, and m- or p-ethylstyrene; acrylic or methacrylic acid ester monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and vinyl monomers such as butadiene, isoprene, cyclohexene, acrylo- or methacrylonitrile and acrylic or methacrylic acid amide. Any of these may be used alone, or usually used in the form of an appropriate mixture of monomers so mixed that the theoretical glass transition temperature (Tg) as described in a publication POLYMER HANDBOOK, 2nd Edition III, pp.139–192 (John Wiley & Sons, Inc.) ranges from 40 to 75°

C. If the theoretical glass transition temperature is lower than 40° C., problems may arise in respect of storage stability or running stability of the toner. If on the other hand it is higher than 75° C., the fixing point of the toner may become higher. Especially in the case of color toners used to form full-color images, the color mixing performance of the respective color toners at the time of fixing may be unsatisfactory, resulting in a poor color reproducibility, and also OHP images may have a very poor transparency. Thus, such temperatures are not preferable in view of high image quality.

In the present invention, in order to encapsulate the low-softening substance with the shell resin, it is particularly preferable to further add a polar resin in addition to the shell resin. As the polar resin used in the present invention, copolymers of styrene with acrylic or methacrylic acid, maleic acid copolymers, saturated polyester resins and epoxy resins are preferably used. The polar resin may particularly preferably be those not containing in the molecule any unsaturated groups that may react with the shell resin and the polymerizable monomer. If a polar resin having such unsaturated groups is used, cross-linking reaction takes place between the polar resin and the polymerizable monomer that forms the shell resin layer, so that the shell resin comes to have a too high molecular weight for the toners for forming full-color images and is disadvantageous for color mixing performance of four color toners. Thus, such a resin is not preferable.

As the low-softening substance used in the present invention, it is preferable to use a compound showing a DSC (differential scanning calorimetry) main maximum peak value within a temperature range of from 40 to 90° C. as measured according to ASTM D3418-8. If the maximum peak is lower than 40° C., the low-softening substance may have a weak self-cohesive force, undesirably resulting in weak high-temperature anti-offset properties. If on the other hand the maximum peak is higher than 90° C., fixing temperature may become higher to make it difficult to smoothen the fixed-image surface appropriately. This is undesirable in view of color mixing performance. Moreover, in the case when the toner is directly produced by polymerization, if the maximum peak value is at a high temperature, the low-softening substance may precipitate mostly during granulation in the aqueous medium to hinder the reaction of suspension polymerization undesirably.

The temperature of the maximum peak value is measured using, e.g., DSC-7, manufactured by Perkin Elmer Co. The temperature at the detecting portion of the device is corrected on the basis of melting points of indium and zinc, and the calorie is corrected on the basis of heat of fusion of indium. The sample is put in a pan made of aluminum and an empty pan is set as a control, to make measurement at a rate of temperature rise of 10° C./min.

The low-softening substance may specifically include paraffin waxes, polyolefin waxes, Fischer-Tropsch waxes, amide waxes, higher fatty acids, ester waxes, and derivatives of these or grafted or blocked compounds of these, any of which may be used.

Ester waxes having at least one long-chain ester moiety having at least 10 carbon atoms as shown by the following structural formulas are particularly preferred in the present invention as being effective for the high temperature anti-offset properties without impairment of the transparency required for OHP. Structural formulas of typical compounds of specific ester waxes preferred in the present invention are shown below as General Structural Formulas (1) to (3).

Ester Wax General Structural Formula (1)

$$[R_1\text{—COO—}(CH_2)_n]_a\text{C}[(CH_2)_m\text{—OCO—}R_2]_b$$

wherein a and b each represent an integer of 0 to 4, provided that a+b is 4; $R_1$ and $R_2$ each represent an organic group having 1 to 40 carbon atoms, provided that a difference in the number of carbon atoms between $R_1$ and $R_2$ is 10 or more; and n and m each represent an integer of 0 to 15, provided that n and m are not 0 at the same time.

Ester Wax General Structural Formula (2)

$$[R_1\text{—COO—}(CH_2)_n]_a\text{C}[(CH_2)_m\text{—OH}]_b$$

wherein a and b each represent an integer of 0 to 4, provided that a+b is 4; $R_1$ represents an organic group having 10 to 40 carbon atoms; and n and m each represent an integer of 0 to 15, provided that n and m are not 0 at the same time.

Ester Wax General Structural Formula (3)

$$[R_1\text{—COO—}(CH_2)_n]_a\text{C}(R_3)[(CH_2)_m\text{—OCO—}R_2]_b$$

wherein a and b each represent an integer of 0 to 3, provided that a+b is 3 or less; $R_1$ and $R_2$ each represent an organic group having 1 to 40 carbon atoms, provided that a difference in the number of carbon atoms between $R_1$ and $R_2$ is 10 or more; $R_3$ represents an organic group having 1 or more carbon atoms; and n and m each represent an integer of 0 to 15, provided that n and m are not 0 at the same time.

The ester wax preferably used in the present invention may preferably be those having a hardness of from 0.5 to 5.0. The hardness of the ester wax is a value obtained by preparing a sample having a cylindrical shape of 20 mm diameter and 5 mm thick and thereafter measuring Vickers hardness by the use of, e.g., a dynamic ultrafine hardness meter (DUH-200) manufactured by Shimadzu Corporation. As measurement conditions, a penetrator's position is moved by 10 μm under a load of 0.5 g at a loading rate of 9.67 mm/sec. Thereafter, it is kept as it is for 15 seconds, and a depression made on the sample is measured to determine Vickers hardness. If the ester wax has a hardness lower than 0.5, the fixing assembly may have a great dependence on pressure and on process speed, tending to make the achievement of high-temperature anti-offset effect insufficient. If on the other hand it has a hardness higher than 5.0, the toner may have a poor storage stability, and the wax itself may also have a weak self-cohesive force, likewise tending to result in insufficient high-temperature anti-offset properties.

As specific compounds, the ester wax may include the following compounds.

Compound (1)

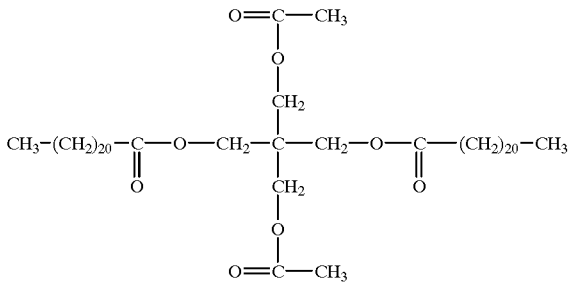

-continued

Compound (2)

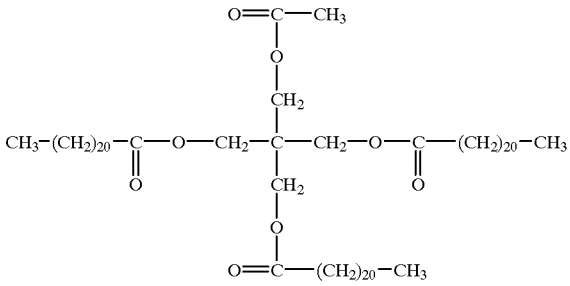

Compound (3)

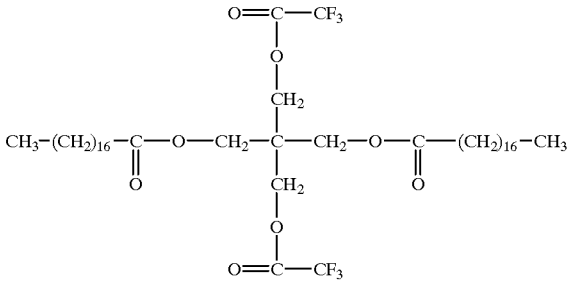

Compound (4)

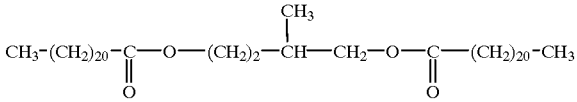

In recent years, it has become increasingly necessary to form full-color double-sided images. When such double-sided images are formed, there is a possibility that a toner image first formed on the surface of a transfer medium again passes through the heating section of a fixing assembly also when an image is next formed on the back. Thus, the high-temperature anti-offset properties of the toner must be well taken into account. For this end also, it is essential in the present invention to add the low-softening substance in a large amount. Stated specifically, the low-softening substance may preferably be added in the toner in an amount of from 5 to 40% by weight. Its addition in an amount less than 5% by weight may provide no sufficient high-temperature anti-offset properties. Moreover, the back-side images tend to show the phenomenon of offset when double-sided images are fixed. On the other hand, in an amount more than 40% by weight, the toner particles tend to coalesce one another during granulation, so that those having a broad particle size distribution tend to be produced, and are unsuitable for the present invention.

As the colorant used in the present invention, carbon black, magnetic materials, and colorants toned in black by the use of yellow, magenta and cyan colorants shown below may be used as black colorants.

As a yellow colorant, compounds typified by condensation azo compounds, isoindolinone compounds, anthraquinone compounds, azo metal complexes, methine compounds and allylamide compounds are used. Stated specifically, C.I. Pigment Yellow 12, 13, 14, 15, 17, 62, 74, 83, 93, 94, 95, 109, 110, 111, 128, 129, 147 and 168 are preferably used.

As a magenta colorant, condensation azo compounds, diketopyropyyrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 122, 144, 146, 166, 169, 177, 184, 185, 202, 206, 220, 221 and 254 are particularly preferred.

As a cyan colorant, copper phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62 and 66 may be particularly preferably used.

Any of these colorants may be used alone, in the form of a mixture, or in the state of a solid solution. The colorant used in the present invention are selected taking account of hue angle, chroma, brightness, weatherability, transparency on OHP films and dispersibility in toner particles. The colorant may preferably be added in an amount of from 1 to 20 parts by weight based on 100 parts by weight of the resin.

In the case when a magnetic material is used as the black colorant, it may preferably be used in an amount of from 40 to 150 parts by weight based on 100 parts by weight of the resin, which is different from the amount of other colorant.

As a charge control agent used in the present invention, known agents may be used. It is preferable to use charge control agents that are colorless, make toner charging speed higher and are capable of stably maintaining a constant charge quantity. Also, when direct polymerization is used in the present invention, charge control agents having no polymerization inhibitory action and being insoluble in the aqueous system are particularly preferred. As specific compounds, they may include, as negative charge control agents, metal compounds of salicylic acid, naphthoic acid or dicarboxylic acids, polymer type compounds having sulfonic acid or carboxylic acid in the side chain, boron compounds, urea compounds, silicon compounds and carixarene. As positive charge control agents, they may include quaternary ammonium salts, polymer type compounds having such a quaternary ammonium salt in the side chain, guanidine compounds, and imidazole compounds. Any of these charge control agent may preferably be used in a amount of from 0.5 to 10 parts by weight based on 100 parts by weight of the resin. In the present invention, however, the addition of the charge control agent is not essential. In the case when two-component development is employed, the triboelectric charging with a carrier may be utilized, and also in the case when non-magnetic one-component blade coating development is employed, the triboelectric charging with a blade member or sleeve member may be utilized. Hence, the charge control agent need not necessarily be contained in the toner particles.

A polymerization initiator used in the present invention may include, e.g., azo or diazo type polymerization initiators such as 2,2'-azobis-(2,4-dimethylvaleronitrile), 2,2'-azobisisobutyronitrile), 1,1'-azobis-(cyclohexane-l-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide and lauroyl peroxide. The polymerization initiator may usually be used in an amount of from 0.5 to 20% by weight based on the weight of the polymerizable monomers, which varies depending on the intended degree of polymerization. The polymerization initiator may a little vary in type depending on the methods for polymerization, and may be used alone or in the form of a mixture, making reference to its 10-hour half-life period temperature.

In order to control the degree of polymerization, any known cross-linking agent, chain transfer agent and polymerization inhibitor may be further added.

When the suspension polymerization making use of a dispersant is utilized in the polymerization toner according to the present invention, the dispersant used may include, e.g., as inorganic oxides, tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. As organic compounds, it may include polyvinyl alcohol, gelatin, methyl cellulose, methyl hydroxypropyl cellulose, ethyl cellulose, carboxymethyl cellulose sodium salt, polyacrylic acid and salts thereof, and starch; which may be dispersed in an aqueous phase when used. Any of the dispersants may preferably be used in an amount of from 0.2 to 20 parts by weight based on 100 parts by weight of the polymerizable monomer.

As these dispersants, those commercially available may be used as they are. In order to obtain fine particles, however, the inorganic compound may be formed in the dispersion medium. For example, in the case of tricalcium phosphate, an aqueous sodium phosphate solution and an aqueous calcium chloride solution may be mixed under high-speed agitation.

In order to make these dispersants finely dispersed, 0.001 to 0.1 parts by weight of a surface-active agent may be used in combination. This is used in order to accelerate the intended action of the dispersant. As examples thereof, it may include sodium dodecylbenzenesulfate, sodium tetradecylsulfate, sodium pentadecylsulfate, sodium octylsulfate, sodium oleate, sodium laurate, potassium stearate and calcium oleate.

In the toner production process of the present invention, the toner particles can be produced specifically by a production process as described below.

A monomer composition comprising polymerizable monomers and added therein the low-softening substance (as a release agent), the colorant, the charge control agent, the polymerization initiator and other additives, having been uniformly dissolved or dispersed by means of a homogenizer or an ultrasonic dispersion machine, is dispersed in an aqueous phase containing the dispersant, by means of a conventional stirrer, a homomixer or a homogenizer. Granulation is carried out preferably while controlling the agitation speed and time so that droplets of the monomer composition can have the desired toner particle size. After the granulation, agitation may be carried out to such an extent that the state of particles is maintained and the particles can be prevented from settling by the acton of the dispersant. The polymerization may be carried out at a polymerization temperature set at 40° C. or above, usually from 50 to 90° C. At the latter half of the polymerization, the temperature may be raised, and also the aqueous medium may be removed in part from the reaction system at the latter half of the reaction or after the reaction has been completed, in order to remove unreacted polymerizable monomers, by-products and so forth which are causative of a smell at the time of toner fixing. After the reaction has been completed, the toner particles formed are collected by washing and filtration, followed by drying. In such suspension polymerization, water may usually be used as the dispersion medium preferably in an amount of from 300 to 3,000 parts by weight based on 100 parts by weight of the polymerizable monomer composition.

The water content referred to in the present invention is, as stated previously, determined by weight loss on heating at 105° C.

The quantity of residual monomers in toner is determined using a sample prepared by dissolving 0.2 g of toner in 4 ml of tetrahydrofuran (THF) and subjecting the sample to gas chromatography (G.C.) to make measurement by the internal standard method under the following conditions.

G.C. conditions

Measuring device: Shimadzu GC-15A (with capillary)

Carrier gas: $N_2$, 2 kg/cm$^2$, 50 ml/min.

Split ratio: 1:60

Linear velocity: 30 mm/sec.

Column: ULBON HR-1, 50 m×0.25 mm

Amount of sample: 2 $\mu$l

Standard substance: Toluene (1) Particle size distribution of the toner can be measured by various methods. In the present invention, it was measured with a Coulter counter.

As a measuring device, Coulter counter Model TA-II (manufactured by Coulter Electronics, Inc.) is used. An interface (manufactured by Nikkaki K.K.) that outputs number-average distribution and volume-average distribution and a personal computer CX-1 (manufactured by CANON INC.) are connected. As an electrolytic solution, an aqueous 1% NaCl solution is prepared using first-grade sodium chloride.

Measurement is made by adding as a dispersant 0.1 to 5 ml of a surface active agent, preferably alkylbenzene sulfonate, to 100 to 150 ml of the above aqueous electrolytic solution, and further adding 2 to 20 mg of a sample to be measured. The electrolytic solution in which the sample has been suspended is subjected to dispersion for about 1 minute to about 3 minutes in an ultrasonic dispersion machine. The values are determined by measuring the particle size distribution of particles of 2 to 40 $\mu$m on the basis of number, by means of the Coulter counter Model TA-II, using an aperture of 100 $\mu$m as its aperture.

EXAMPLES

The present invention will be described below in a specific manner by giving Examples.

Example 1

Into 710 parts of ion-exchanged water, 450 parts of an aqueous 0.1 mol/liter $Na_3PO_4$ solution was introduced, and the mixture obtained was heated to 60° C., followed by stirring at 3,500 r.p.m. using Kuria mixer (manufactured by Emu Tekunikku K.K.). Then, 68 parts of an aqueous 1.0 mol/liter $CaCl_2$ solution was added thereto to obtain an aqueous medium containing $Ca_3(PO_4)_2$.

Meanwhile, a disperse phase was prepared in the following way.

| | (by weight) |
|---|---|
| Styrene monomer | 170 parts |
| n-Butyl acrylate | 30 parts |
| Graphitized carbon black | 10 parts |
| Saturated polyester | 10 parts |
| Salicylic acid metal compound | 3 parts |
| Ester wax, Compound (1) (DSC peak temperature: 59.4° C.; Vickers hardness: 1.5) | 25 parts |

Of the above formulation, 100 parts by weight of the graphitized carbon black, salicylic acid metal compound and styrene monomer were dispersed for 3 hours by means of an attritor (manufactured by Mitsui Miike Engineering Corporation) to obtain a colorant dispersion. Next, the remainder of the above formulation was all added to the colorant dispersion, and these were heated to 60° C. and dissolved and mixed for 30 minutes. To the resultant mixture, 10 parts by weight of a polymerization initiator 2,2'-azobis(2,4-dimethylvaleronitrile) was added to obtain a polymerizable monomer composition.

The polymerizable monomer composition obtained was introduced into the above aqueous dispersion medium to carry out granulation for 15 minutes while maintaining the number of revolution. Thereafter, the high-speed stirrer was changed to a stirrer having propeller stirring blades and the internal temperature was raised to 80° C., where the polymerization was continued for 10 hours at 50 r.p.m. After the polymerization was completed, the slurry was cooled, and dilute hydrochloric acid was added to dissolve the $Ca_3(PO_4)_2$. Thereafter, the slurry thus treated was filtered, and washed with water to obtain wet colored polymer particles having a water content of 22% by weight. The polymer particles thus obtained had a weight-average particle diameter of 6.2 μm.

About 40 kg of the wet colored polymer particles obtained were disintegrated and thereafter dried by means of a fluidized bed dryer (Model FBS-5, manufactured by Ohkawara Seisakusho K.K.) having the construction as shown in FIG. 6. As drying conditions, 50° C. air was blown at a linear velocity of 0.4 m/second, and the toner particles thus primarily dried were taken out 2 hours later, where their water content was measured to find that it was 0.3% by weight. At this stage, the polymerizable monomers remaining in the toner particles were in a content of 450 ppm. Any powder lumps caused by the agglomeration of toner particles did not occur, and the pass percentage on a sieve with a mesh of 149 μm was 96%. The "pass percentage" herein referred to is determined in the following way.

Pass percentage (%)={(weight (g) of toner particles having passed through the sieve)/(weight (g) of toner particles)}×100

Next, about 30 kg of the primarily dried toner particles taken out were dried by means of a Nauta type vacuum dryer (Model NXV-1, manufactured by Hosokawa Micron K.K.) with a volume of 100 liters, having the construction as shown in FIG. 2. As drying conditions, the jacket heating temperature was set at 50° C. and the particles were dried at a degree of vacuum of 2 to 5 kPa for 4 hours. At this stage, their water content was 0.1% by weight, and the polymerizable monomers remaining in the toner particles were in a content of 50 ppm. The pass percentage on a sieve with a mesh of 149 μm was 95%.

A photograph of cross sections of the toner particles thus obtained was taken. Its diagrammatic view is shown in FIG. 5. The toner particles have the structure wherein the low-softening substance, Compound (1), is covered with the shell resin.

Coarse powder in the toner particles obtained was removed by classification. To 100 parts by weight of the toner particles from which the coarse powder was removed, 1.5 parts by weight of hydrophobic silica having a specific surface area of 200 $m^2/g$ as measured by the BET adsorption method was externally added to obtain a toner.

Using this toner, image reproduction was tested on a modified machine of a color laser jet printer COLOR LASER SHOT 2030, manufactured by CANON INC., in an environment of 23° C./65% RH. As a result, even in 5,000-sheet running, high-quality images were obtained, showing no change in image density between that of initial stage and that after the running and causing no blank areas. Also, any problems such as toner melt-adhesion and memory ghost did not occur on the printer's photosensitive member formed of an organic semiconductor. Double-sided images were also formed, but any offset did not occur on the both sides of transfer materials.

Image reproduction was also similarly tested in an environment of 30° C./80% RH. As a result, good results were obtained similarly.

Example 2

Primarily dried toner particles were obtained in the same manner as in Example 1 except that the time for which the wet particles were dried using the fluidized bed dryer was changed to 1.5 hours. The water content of the toner particles was measured to find that it was 0.7% by weight. The polymerizable monomers remaining in the toner particles were in a content of 610 ppm. The pass percentage on a sieve with a mesh of 149 μm was 97%.

Next, about 30 kg of the primarily dried toner particles obtained were dried by means of the Nauta type vacuum dryer (Model NXV-1, manufactured by Hosokawa Micron K.K.) in the same manner as in Example 1 except that the drying time was changed to 5 hours. Thus, toner particles were produced. At this stage, their water content was 0.1% by weight, and the polymerizable monomers remaining in the toner particles were in a content of 90 ppm. The pass percentage on a sieve with a mesh of 149 μm was 95%.

To the toner particles thus obtained, the silica was externally added in the same manner as in Example 1 to obtain a toner.

Using this toner, images were reproduced and evaluated in the same manner as in Example 1. As a result, good results were obtained like those in Example 1.

Example 3

About 20 kg of the primarily dried toner particles obtained by drying with the fluidized bed dryer for 2 hours in Example 1 were put into Ribocone vacuum dryer (Model RD-50, manufactured by Ohkawara Seisakusho K.K.) with a volume of 50 liters, having the construction as shown in FIG. 3, and were vacuum-dried at 50° C. and a degree of vacuum of 0.7 to 2 kPa. The toner particles were taken out 4 hours later, where their water content was measured to find that it was 0.1% by weight, and the pass percentage on a sieve with a mesh of 149 μm was 90%. Also, the polymerizable monomers remaining in the toner particles were in a content of 120 ppm.

A toner was prepared and images were reproduced and evaluated in the same manner as in Example 1. As a result, good results were obtained like those in Example 1.

Example 4

First, the same aqueous dispersion medium as that in Example 1 was prepared.

Meanwhile, a disperse phase was prepared in the following way.

| | (by weight) |
|---|---|
| Styrene monomer | 180 parts |
| 2-Ethylhexyl acrylate | 20 parts |
| C.I. Pigment Blue 15:3 | 10 parts |
| Saturated polyester | 10 parts |

-continued

| | (by weight) |
|---|---|
| Salicylic acid metal compound | 5 parts |
| Ester wax, Compound (1) | 25 parts |

Of the above formulation, 100 parts by weight of the C.I. Pigment Blue 15:3, salicylic acid metal compound and styrene monomer were dispersed for 3 hours by means of an attritor (manufactured by Mitsui Miike Engineering Corporation) to obtain a colorant dispersion. Next, the remainder of the above formulation was all added to the colorant dispersion, and these were heated to 60° C. and dissolved and mixed for 30 minutes. To the resultant mixture, 10 parts by weight of a polymerization initiator 2,2'-azobis(2,4-dimethylvaleronitrile) was added to obtain a polymerizable monomer composition.

The polymerizable monomer composition obtained was introduced into the above aqueous dispersion medium to carry out granulation for 15 minutes while maintaining the number of revolution. Thereafter, the high-speed stirrer was changed to a stirrer having propeller stirring blades and the internal temperature was raised to 80° C., where the polymerization was continued for 10 hours at 50 r.p.m. After the polymerization was completed, the slurry was cooled, and dilute hydrochloric acid was added to dissolve the $Ca_3(PO_4)_2$. Thereafter, the slurry thus treated was filtered, and washed with water to obtain wet colored polymer particles having a water content of 23% by weight. The polymer particles thus obtained had a weight-average particle diameter of 6.5 μm.

Figure 4:
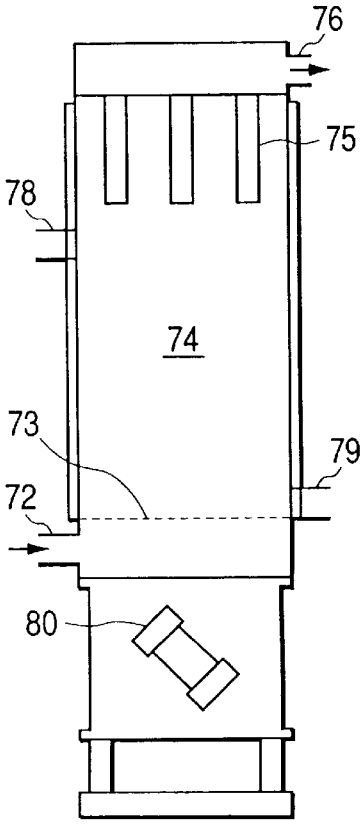
FIG. 4 is a diagrammatic transverse cross-sectional view showing a fluidized bed dryer to which mechanical vibration is added, as used in Example 4.

Next, the wet colored polymer particles thus obtained, having a water content of 23% by weight, were put into a vibro-fluidized bed dryer having a vertically cylindrical shape as shown in FIG. 4, and then dried.

The apparatus as shown in FIG. 4 has a cylindrical form on the whole, and is constituted of a gas inlet 72, a grating plate 73 for rectifying a gas, a drying chamber 74 in which a fluidized bed of particles and gas is formed, a filter 75 for capturing the particles, and an exhaust vent 76, which are provided along the gas flow path.

Two sets of vibrating motors (vibrators) 80 are also assembled to the side walls facing to each other, of the stand supporting the drying chamber at its bottom so that the whole drying chamber can be vibrated. The amplitude of vibration can be adjusted by changing the set angle between unbalance weights set on the both ends of the vibrating motors, and the number of vibration (or frequency) can arbitrarily be set by an inverter.

The drying target is fed into the drying chamber 78 through its feed opening 78 and a dried product is taken out through a take-out opening 79 of the lower fluidizing chamber.

The drying carried out using this drying apparatus is operated, e.g., in the following way: The drying target particles fed into the drying chamber 74 are suspended by the mechanical vibration applied from the vibrating motors 80 and simultaneously blown up by the hot air fed through the gas inlet 72 and introduced via the grating plate 73, and are fluidized together with the gas. The drying target particles suspended inside the drying chamber 74 to form a fluidized bed are uniformly mixed with the gas and dried at the interior of this fluidized bed.

The drying target particles blown up to the upper part (the exhaust vent 76 side) of the drying chamber 74 are captured by the filter 75, where, e.g., a back-wash pulse may be applied to this filter, thus the drying target particles are brushed off to return downward.

In the present Example, as drying conditions, a vibration of 25 Hz in frequency and 2.5 mm in amplitude was applied and 50° C. air was blown from the lower part at a linear velocity of 0.2 m/second. The toner particles thus primarily dried were taken out 2 hours later, where their water content was measured to find that it was 0.3% by weight. At this stage, the polymerizable monomers remaining in the toner particles were in a content of 400 ppm. Any powder lumps caused by the agglomeration of toner particles did little occur, and the pass percentage on a sieve with a mesh of 149 μm was 94%.

Next, about 30 kg of the primarily dried toner particles obtained were dried by means of the Nauta type vacuum dryer (Model NXV-1, manufactured by Hosokawa Micron K.K.) in the same manner as in Example 1. Thus, toner particles were produced. At this stage, their water content was 0.1% by weight, and the polymerizable monomers remaining in the toner particles were in a content of 40 ppm. The pass percentage on a sieve with a mesh of 149 μm was 93%.

A toner was prepared and images were reproduced and evaluated in the same manner as in Example 1. As a result, good results were obtained like those in Example 1. Images were also formed on OHP sheets, where images with a good transparency were obtained.

Example 5

Primarily dried toner particles were obtained in the same manner as in Example 1 except that the time for which the wet particles were dried using the fluidized bed dryer was changed to 3 hours. The water content of the toner particles was measured to find that it was 0.1% by weight. The polymerizable monomers remaining in the toner particles were in a content of 310 ppm. The pass percentage on a sieve with a mesh of 149 μm was 92%.

Next, about 30 kg of the primarily dried toner particles obtained were dried for 4 hours by means of the Nauta type vacuum dryer in the same manner as in Example 1. Thus, toner particles were produced. At this stage, their water content was 0.1% by weight, and the polymerizable monomers remaining in the toner particles were in a content of 40 ppm. The pass percentage on a sieve with a mesh of 149 μm was 91%.

A toner was also prepared and images were reproduced and evaluated in the same manner as in Example 1. As a result, good results were obtained like those in Example 1.

Example 6

About 30 kg of the primarily dried toner particles obtained by drying with the fluidized bed dryer for 2 hours in Example 1 were dried using the Nauta type vacuum dryer under the following conditions. Jacket heating temperature: 50° C.; degree of vacuum: 2 to 5 kPa; and drying time: 3 hours while feeding nitrogen gas from the lower part at a rate of 0.5 N liter/min. At this stage, the water content was 0.1% by weight, and the polymerizable monomers remaining in the toner particles were in a content of 30 ppm. Also, the pass percentage on a sieve with a mesh of 149 μm was 96%.

A toner was also prepared and images were reproduced and evaluated in the same manner as in Example 1. As a result, good results were obtained like those in Example 1.

Comparative Example 1

About 40 kg of the wet colored polymer particles obtained in Example 1, having a water content of 22% by weight, were disintegrated and thereafter dried by means of the fluidized bed dryer (Model FBS-5, manufactured by Ohkawara Seisakusho K.K.). As drying conditions, 50° C. air was blown at a linear velocity of 0.4 m/second, and the toner particles were taken out 4 hours later, where their water content was measured to find that it was less than 0.1% by weight. The polymerizable monomers remaining in the toner particles were in a content of 180 ppm, but the powder lumps caused by the agglomeration of toner particles occurred, and the pass percentage on a sieve with a mesh of 149 μm was 85%. Also, a deposit of toner particles was seen on the inner wall of the dryer. This deposit of toner particles was taken out to measure its water content, which was found to be less than 0.1% by weight, and the polymerizable monomers remaining in the toner particles in the deposit were in a content of 310 ppm.

On the toner particles thus obtained, the subsequent procedure of Example 1 was repeated to obtain a toner.

Image reproduction was tested in the same manner as in Example 1. As a result, solid-area blank areas caused by poor transfer occurred after running on about 1,500 sheets, and also faulty images due to the melt-adhesion of toner to photosensitive member occurred in the environment of 30° C./80% RH on about 4,500th sheet.

Comparative Example 2

The wet colored polymer particles obtained in Example 1, having a water content of 22% by weight, were dispersed over an aluminum pat, and vacuum-dried at 50° C. and a degree of vacuum of 3 kPa. The water content of the particles thus dried 2 hours later was measured to find that it was 12% by weight. The particles were further dried for 16 hours until their water content came to be 0.1% by weight or less. The toner particles obtained had agglomerated in part, and the pass percentage on a sieve with a mesh of 149 μm was 70%. Also, the polymerizable monomers remaining in the toner particles were in a content of 180 ppm.

The toner particles thus obtained were disintegrated, and the subsequent procedure of Example 1 was repeated to obtain a toner.

Images were reproduced and evaluated in the same manner as in Example 1. As a result, solid-area blank areas caused by poor transfer occurred after running on about 500th sheets.

Comparative Example 3

About 30 kg of the wet colored polymer particles obtained in Example 1, having a water content of 22% by weight, were disintegrated and thereafter dried by means of the Nauta type vacuum dryer (Model NXV-1, manufactured by Hosokawa Micron K.K.) with a volume of 100 liters. As drying conditions, jacket heating temperature was set at 50° C. and the particles were dried for 4 hours at a degree of vacuum of 2 to 5 kPa. At this stage, the water content of the toner particles was measured to find that it was 0.3% by weight, and the polymerizable monomers remaining in the toner particles were in a content of 520 ppm. The pass percentage on a sieve with a mesh of 149 μm was 75%.

The toner particles thus obtained were disintegrated and the subsequent procedure of Example 1 was repeated to obtain a toner. Image reproduction was tested in the same manner as in Example 1. As a result, solid-area blank areas caused by poor transfer occurred on about 1,000th sheet, and also faulty images due to the melt-adhesion of toner to photosensitive member occurred in the environment of 30° C./80% RH on about 2,000th sheet.

Comparative Example 4

About 30 kg of the wet colored polymer particles obtained in Example 1, having a water content of 22% by weight, were disintegrated and thereafter dried by means of the Nauta type vacuum dryer (Model NXV-1, manufactured by Hosokawa Micron K.K.) with a volume of 100 liters. As drying conditions, jacket heating temperature was set at 50° C., and the particles were dried for 7 hours at a degree of vacuum of 2 to 5 kPa. At this stage, the water content of the toner particles was measured to find that it was 0.1% by weight, and the polymerizable monomers remaining in the toner particles were in a content of 190 ppm. The pass percentage on a sieve with a mesh of 149 μm was 70%.

The toner particles thus obtained were disintegrated and the subsequent procedure of Example 1 was repeated to obtain a toner. Image reproduction was tested in the same manner as in Example 1. As a result, solid-area blank areas caused by poor transfer occurred on about 500th sheet.

Comparative Example 5

About 40 kg of the wet colored polymer particles obtained in Example 1, having a water content of 22% by weight, were disintegrated and thereafter dried by means of the fluidized bed dryer (Model FBS-5, manufactured by Ohkawara Seisakusho K.K.). As drying conditions, 50° C. air was blown at a linear velocity of 0.4 m/second, and the toner particles were taken out 6 hours later, where their water content was measured to find that it was 0.1% by weight. The polymerizable monomers remaining in the toner particles were in a content of 70 ppm, but the powder lumps caused by the agglomeration of toner particles occurred, and the pass percentage on a sieve with a mesh of 149 μm was 75%. Also, a deposit of toner particles was seen on the inner wall of the dryer. This deposit of toner particles was taken out to measure its water content, which was found to be less than 0.1% by weight, and the polymerizable monomers remaining in the toner particles in the deposit were in a content of 280 ppm.

The toner particles thus obtained were disintegrated and the subsequent procedure of Example 1 was repeated to obtain a toner.

Image reproduction was tested in the same manner as in Example 1. As a result, solid-area blank areas caused by poor transfer occurred on about 1,000th sheet, and also faulty images due to the melt-adhesion of toner to photosensitive member occurred in the environment of 30° C./80% RH on about 2,000th sheet.

The results of measurement and evaluation in the foregoing Examples and Comparative Examples are shown in Table 1.

Example 7

Into 710 parts of ion-exchanged water, 450 parts of an aqueous 0.1 mol/liter $Na_3PO_4$ solution was introduced, and the mixture obtained was heated to 60° C., followed by stirring at 3,500 r.p.m. using Kuria mixer (manufactured by Emu Tekunikku K.K.). Then, 68 parts of an aqueous 1.0 mol/liter $CaCl_2$ solution was added thereto to obtain an aqueous medium containing $Ca_3(PO_4)_2$.

Meanwhile, a disperse phase was prepared in the following way.

| | (by weight) |
|---|---|
| Styrene monomer | 170 parts |
| n-Butyl acrylate | 30 parts |
| C.I. Pigment Red 122 | 10 parts |
| Saturated polyester | 20 parts |
| Salicylic acid metal compound | 3 parts |
| Ester wax, Compound (1) (DSC peak temperature: 59.4° C.; Vickers hardness: 1.5) | 25 parts |

Of the above formulation, 100 parts by weight of the C.I. Pigment Red 122, salicylic acid metal compound and styrene monomer were dispersed for 3 hours by means of an attritor (manufactured by Mitsui Miike Engineering Corporation) to obtain a colorant dispersion. Next, the remainder of the above formulation was all added to the colorant dispersion, and these were heated to 60° C. and dissolved and mixed for 30 minutes. To the resultant mixture, 10 parts by weight of a polymerization initiator 2,2'-azobis(2,4-dimethylvaleronitrile) was added to obtain a polymerizable monomer composition.

The polymerizable monomer composition obtained was introduced into the above aqueous dispersion medium to carry out granulation for 15 minutes while maintaining the number of revolution. Thereafter, the high-speed stirrer was changed to a stirrer having propeller stirring blades and the internal temperature was raised to 80° C., where the polymerization was continued for 10 hours at 50 r.p.m. After the polymerization was completed, the slurry was cooled, and dilute hydrochloric acid was added to dissolve the $Ca_3(PO_4)_2$. Thereafter, the slurry thus treated was filtered, and washed with water to obtain wet colored polymer particles having a water content of 22% by weight. The polymer particles thus obtained had a weight-average particle diameter of 6.5 $\mu$m.

The wet colored polymer particles obtained were disintegrated and thereafter dried by means of a continuous instantaneous air dryer (Flash Jet dryer FJD-4, manufactured by Seishin Kigyo K.K.). As drying conditions, 90° C. air was blown at a linear velocity of 16.5 m/second, and the wet colored polymer particles were continuously fed at a rate of 20 kg/hr. It took 0.7 second for the drying. The water content of the toner particles thus primarily dried was measured to find that it was 0.1% by weight. At this stage, the polymerizable monomers remaining in the toner particles were in a content of 530 ppm. Any powder lumps caused by the agglomeration of toner particles did not occur, and the pass percentage on a sieve with a mesh of 149 $\mu$m was 97%.

Next, about 30 kg of the primarily dried toner particles taken out were dried by means of the Nauta type vacuum dryer (Model NXV-1, manufactured by Hosokawa Micron K.K.) with a volume of 100 liters. As drying conditions, the jacket heating temperature was set at 50° C. and the particles were dried at a degree of vacuum of 2 to 5 kPa for 3 hours while feeding nitrogen gas from the lower part at a rate of 5.0 N liter/min. At this stage, the polymerizable monomers remaining in the toner particles were in a content of 20 ppm. The pass percentage on a sieve with a mesh of 149 $\mu$m was 96%.

A photograph of cross sections of the toner particles thus obtained was taken. Its diagrammatic view is shown in FIG. 5. The toner particles have the structure wherein the low-softening substance, Compound (1), is covered with the shell resin.

Coarse powder in the toner particles obtained was removed by classification. To 100 parts by weight of the toner particles from which the coarse powder was removed, 1.5 parts by weight of hydrophobic silica having a specific surface area of 200 $m^2/g$ as measured by the BET adsorption method was externally added to obtain a toner.

Using this toner, image reproduction was tested on a modified machine of a color laser jet printer COLOR LASER SHOT 2030, manufactured by CANON INC., in an environment of 23° C./65% RH. As a result, even in 5,000-sheet running, high-quality images were obtained, showing no change in image density between that of initial stage and that after the running and causing no blank areas. Also, any problems such as toner melt-adhesion and memory ghost did not occur on the printer's photosensitive member formed of an organic semiconductor. Double-sided images were also formed, but any offset did not occur on the both sides of transfer materials. Images were also formed on OHP sheets, where images with a good transparency were obtained.

Image reproduction was also similarly tested in an environment of 30° C./80% RH. As a result, good results were obtained similarly.

Example 8

About 30 kg of the primarily dried toner particles obtained in Example 7, dried using the continuous instantaneous air dryer, were dried for 4 hours by means of the same vacuum dryer (Model NXV-1) without feeding nitrogen gas from the lower part and under conditions of a jacket heating temperature of 50° C. and a degree of vacuum of 2 to 5 kPa. At this stage, the polymerizable monomers remaining in the toner particles were in a content of 40 ppm. The pass percentage on a sieve with a mesh of 149 $\mu$m was 95%.

On the toner particles thus obtained, the subsequent procedure of Example 7 was repeated to obtain a toner. Also, images were reproduced and evaluated in the same manner as in Example 7. As a result, good results were obtained like those in Example 7.

Example 9

About 20 kg of the primarily dried toner particles obtained in Example 7, dried using the continuous instantaneous air dryer, were put into Ribocone vacuum dryer (Model RD-50, manufactured by Ohkawara Seisakusho K.K.) with a volume of 50 liters, and were dried for 4 hours at 50° C. and a degree of vacuum of 0.7 to 2 kPa to obtain particles. Their pass percentage on a sieve with a mesh of 149 $\mu$m was 90%. Also, the polymerizable monomers remaining in the toner particles were in a content of 80 ppm.

On the toner particles thus obtained, the subsequent procedure of Example 7 was repeated to obtain a toner. Also, images were reproduced and evaluated in the same manner as in Example 7. As a result, good results were obtained like those in Example 7.

Example 10

First, the same aqueous dispersion medium as that in Example 7 was prepared.

Meanwhile, a disperse phase was prepared in the following way.

| | (by weight) |
|---|---|
| Styrene monomer | 180 parts |
| 2-Ethylhexyl acrylate | 20 parts |
| Graphitized carbon black | 10 parts |
| Saturated polyester | 10 parts |
| Salicylic acid metal compound | 5 parts |
| Paraffin wax (m.p. 65° C.; Vickers hardness: 1.6) | 40 parts |

Of the above formulation, 100 parts by weight of the graphitized carbon black, salicylic acid metal compound and styrene monomer were dispersed for 3 hours by means of an attritor (manufactured by Mitsui Miike Engineering Corporation) to obtain a colorant dispersion. Next, the remainder of the above formulation was all added to the colorant dispersion, and these were heated to 60° C. and dissolved and mixed for 30 minutes. To the resultant mixture, 10 parts by weight of a polymerization initiator 2,2'-azobis(2,4-dimethylvaleronitrile) was added to obtain a polymerizable monomer composition.

The polymerizable monomer composition obtained was introduced into the above aqueous dispersion medium to carry out granulation for 15 minutes while maintaining the number of revolution. Thereafter, the high-speed stirrer was changed to a stirrer having propeller stirring blades and the internal temperature was raised to 80° C., where the polymerization was continued for 10 hours at 50 r.p.m. After the polymerization was completed, the slurry was cooled, and dilute hydrochloric acid was added to dissolve the $Ca_3(PO_4)_2$. Thereafter, the slurry thus treated was filtered, and washed with water to obtain wet colored polymer particles having a water content of 23% by weight. The polymer particles thus obtained had a weight-average particle diameter of 6.1 $\mu$m.

Next, the wet colored polymer particles thus obtained, having a water content of 23% by weight, were disintegrated and thereafter dried by means of the continuous instantaneous air dryer (Flash Jet dryer FJD-4) in the same manner as in Example 7. As drying conditions, 90° C. air was blown at a linear velocity of 16.5 m/second, and the wet colored polymer particles were continuously fed at a rate of 35 kg/hr. The water content of the toner particles thus primarily dried was measured to find that it was 0.1% by weight. At this stage, the polymerizable monomers remaining in the toner particles were in a content of 650 ppm. Any powder lumps caused by the agglomeration of toner particles did not occur, and the pass percentage on a sieve with a mesh of 149 $\mu$m was 96%.

Next, about 30 kg of the primarily dried toner particles were dried by means of the Nauta type vacuum dryer (Model NXV-1) in the same manner as in Example 7. As drying conditions, jacket heating temperature was set at 50° C. and the particles were dried at a degree of vacuum of 2 to 5 kPa for 3 hours while feeding nitrogen gas from the lower part at a rate of 5.0 N liter/min. The polymerizable monomers remaining in the toner particles obtained were in a content of 30 ppm. The pass percentage on a sieve with a mesh of 149 $\mu$m was 96%. Also, the toner particles had a weight-average particle diameter of 6.1 $\mu$m. A photograph of cross sections of the toner particles thus obtained was taken. Its diagrammatic view is shown in FIG. 5. The toner particles have the structure wherein the low-softening substance is covered with the shell resin.

Coarse powder in the toner particles obtained was removed by classification. To 100 parts by weight of the toner particles from which the coarse powder was removed, 1.2 parts by weight of hydrophobic silica having a specific surface area of 200 $m^2/g$ as measured by the BET adsorption method was externally added to obtain a toner.

Using this toner, images were reproduced and evaluated in the same manner as in Example 7. As a result, even in 5,000-sheet running, high-quality images were obtained, showing no change in image density between that of initial stage and that after the running and causing no blank areas. Also, any problems such as toner melt-adhesion and memory ghost did not occur on the printer's photosensitive member formed of an organic semiconductor.

Example 11

The slurry obtained in Example 10 after the polymerization was completed was cooled, and dilute hydrochloric acid was added to dissolve the $Ca_3(PO_4)_2$. Thereafter, the slurry thus treated was filtered, and washed with water. The resultant colored polymer particles standing wet were mixed with water to obtain a slurry containing 25% by weight of colored polymer particles.

Next, this slurry having been washed was continuously fed to the continuous instantaneous air dryer (Flash Jet dryer FJD-4) at a rate of 5 kg/hr, and 90° C. air was blown at a linear velocity of 16.5 m/second. The water content of the toner particles thus primarily dried was measured to find that it was 0.1% by weight. At this stage, the polymerizable monomers remaining in the toner particles were in a content of 680 ppm. Any powder lumps caused by the agglomeration of toner particles did not occur, and the pass percentage on a sieve with a mesh of 149 $\mu$m was 95%.

Next, about 30 kg of the primarily dried toner particles were dried by means of the Nauta type vacuum dryer (Model NXV-1) in the same manner as in Example 10. The polymerizable monomers remaining in the toner particles obtained were in a content of 70 ppm. The pass percentage on a sieve with a mesh of 149 $\mu$m was 95%.

On the toner particles thus obtained, the subsequent procedure of Example 10 was repeated to obtain a toner. Also, images were reproduced and evaluated in the same manner as in Example 10. As a result, good results were obtained like those in Example 10.

Comparative Example 6

To 100 parts by weight of the primarily dried toner particles obtained in Example 7 using the continuous instantaneous air dryer (water content: 0.1% by weight; content of the polymerizable monomers remaining in the toner particles: 530 ppm), 1.5 parts by weight of hydrophobic silica having a specific surface area of 200 $m^2/g$ as measured by the BET adsorption method was externally added to obtain a toner.

Image reproduction was also tested in the same manner as in Example 7. As a result, solid-area blank areas caused by poor transfer occurred after running on about 500 sheets, and a decrease in image density was seen after running on about 2,000 sheets. Also, faulty images due to the melt-adhesion of toner to photosensitive member occurred in the environment of 30° C./80% RH on about 1,500th sheet.

Comparative Example 7

About 40 kg of the wet colored polymer particles obtained in Example 7, having a water content of 22% by weight, were disintegrated and thereafter dried by means of the fluidized bed dryer (Model FBS-5, manufactured by Ohkawara Seisakusho K.K.). As drying conditions, 50° C. air was blown at a linear velocity of 0.4 m/second, and the toner particles were taken out 4 hours later, where their water content was measured to find that it was 0.1% by weight. The polymerizable monomers remaining in the toner particles were in a content of 180 ppm, but the powder lumps caused by the agglomeration of toner particles occurred, and the pass percentage on a sieve with a mesh of 149 μm was 85%. Also, a deposit of toner particles was seen on the inner wall of the dryer. This deposit of toner particles was taken out to measure its water content, which was found to be 0.1% by weight, and the polymerizable monomers remaining in the toner particles in the deposit were in a content of 310 ppm.

On the toner particles thus obtained, the subsequent procedure of Example 7 was repeated to obtain a toner.

Image reproduction was also tested in the same manner as in Example 7. As a result, solid-area blank areas caused by poor transfer occurred after running on about 1,500 sheets, and also faulty images due to the melt-adhesion of toner to photosensitive member occurred in the environment of 30° C./80% RH on about 4,500th sheet.

Comparative Example 8

About 30 kg of the wet colored polymer particles obtained in Example 7, having a water content of 22% by weight, were disintegrated and thereafter dried by means of the Nauta type vacuum dryer (Model NXV-1) with a volume of 100 liters. As drying conditions, jacket heating temperature was set at 50° C., and the particles were dried for 4 hours at a degree of vacuum of 2 to 5 kPa. At this stage, the water content of the toner particles was measured to find that it was 0.3% by weight, and the polymerizable monomers remaining in the toner particles were in a content of 290 ppm. The pass percentage on a sieve with a mesh of 149 μm was 75%.

The toner particles thus obtained were disintegrated and the subsequent procedure of Example 7 was repeated to obtain a toner.

Image reproduction was also tested in the same manner as in Example 7. As a result, solid-area blank areas caused by poor transfer occurred on about 1,000th sheet, and a decrease in image density was seen after running on about 4,000 sheets. Also, faulty images due to the melt-adhesion of toner to photosensitive member occurred in the environment of 30° C./80% RH on about 3,000th sheet.

Comparative Example 9

To 100 parts by weight of the primarily dried toner particles obtained in Example 10 using the continuous instantaneous air dryer (water content: 0.1% by weight; content of the polymerizable monomers remaining in the toner particles: 650 ppm), 1.2 parts by weight of hydrophobic silica having a specific surface area of 200 $m^2/g$ as measured by the BET adsorption method was externally added to obtain a toner.

Image reproduction was also tested in the same manner as in Example 10. As a result, solid-area blank areas caused by poor transfer occurred after running on about 500 sheets, and a decrease in image density was seen after running on about 2,000 sheets. Also, faulty images due to the melt-adhesion of toner to photosensitive member occurred in the environment of 30° C./80% RH on about 2,000th sheet.

Data of the drying conditions and dried products of Examples and Comparative Examples are shown in Table 2.

TABLE 1

| | After fluidized bed drying (primary drying) | | | | After vacuum drying (secondary drying) | | | | |
|---|---|---|---|---|---|---|---|---|---|
| | Drying time (hrs) | Water content (wt. %) | Monomer residue (ppm) | Pass percentage (wt. %) | Drying time (hrs) | Water content (wt. %) | Monomer residue (ppm) | Pass percentage (wt %) | Remarks |
| Example | | | | | | | | | |
| 1 | 2 | 0.3 | 450 | 96 | 4 | 0.1 | 50 | 95 | |
| 2 | 1.5 | 0.7 | 610 | 97 | 5 | 0.1 | 90 | 95 | |
| 3 | 2 | 0.3 | 450 | 96 | 4 | 0.1 | 120 | 90 | |
| 4 | 2 | 0.3 | 400 | 94 | 4 | 0.1 | 40 | 93 | |
| 5 | 3 | 0.1 | 310 | 92 | 4 | 0.1 | 40 | 91 | |
| 6 | 2 | 0.3 | 450 | 96 | 3 | 0.1 | 30 | 96 | |
| Comparative Example | 4 | <0.1 | 180 | 85 | — | — | — | — | |
| 1 | | (0.1)* | (310)* | | | | | | |
| 2 | — | — | — | — | 18 | 0.1 | 180 | 70 | |
| 3 | — | — | — | — | 4 | 0.3 | 520 | 75 | |
| 4 | — | — | — | — | 7 | 0.1 | 190 | 70 | |
| 5 | 6 | <0.1 (0.1)* | 70 (280)* | 75 | — | — | — | — | |

* Value in parentheses is that in toner deposit.

(1): 5000-sheet running: OK (2): Solid-area blank areas occurred after running on 1,500 sheets.

(3): After drying, toner particles had to be disintegrated because of partial agglomeration, and solid-area blank areas occurred after running on 500 sheets.

(4): After drying, toner particles had to be disintegrated because of partial agglomeration, and solid-area blank areas occurred after running on 1,000 sheets.

(5): Solid-area blank areas occurred after running on 1,000 sheets.

TABLE 2

Example 7

Drying target: Wet colored polymer particles with a water content of 22 wt. %
Primary drying conditions:

Hot-stream drying; hot stream: 90° C., 16.5 m/sec.; drying target: 20 kg/hr; drying time: 0.7 seconds
Primary dried product:

Water content: 0.1 wt. %; residual monomers: 530 ppm; sieve pass percentage: 97%
Secondary drying conditions:

Vacuum drying; heating temperature: 50° C.; degree of vacuum: 2–5 kPa; $N_2$ gas: 5.0 N lit/min; drying time: 3 hours
Secondary dried product:

Residual monomers: 20 ppm; sieve pass percentage: 96%

Example 8

Drying target: (the same as Example 7)
Primary drying conditions: (the same as Example 7)
Primary dried product: (the same as Example 7)
Secondary drying conditions:

Vacuum drying; heating temperature: 50° C.; degree of vacuum: 2–5 kPa; $N_2$ gas: not fed; drying time: 4 hours
Secondary dried product:

Residual monomers: 40 ppm; sieve pass percentage: 95%

Example 9

Drying target: (the same as Example 7)
Primary drying conditions: (the same as Example 7)
Primary dried product: (the same as Example 7)
Secondary drying conditions:

Vacuum drying; heating temperature: 50° C.; degree of vacuum: 0.7-2 kPa; drying time: 4 hours
Secondary dried product:

Residual monomers: 80 ppm; sieve pass percentage: 90%

Example 10

Drying target: Wet colored polymer particles with a water content of 23 wt. %
Primary drying conditions:

Hot-stream drying; hot stream: 90° C., 16.5 m/sec.; drying target: 35 kg/hr; drying time: 0.7 seconds
Primary dried product:

Water content: 0.1 wt. %; residual monomers: 650 ppm; sieve pass percentage: 96%
Secondary drying conditions:

Vacuum drying; heating temperature: 50° C.; degree of vacuum: 2–5 kPa; $N_2$ gas: 5.0 N lit/min; drying time: 3 hours
Secondary dried product:

Residual monomers: 30 ppm; sieve pass percentage: 96%

Example 11

Drying target: Slurry containing 25 wt. % of colored polymer particles
Primary drying conditions:

Hot-stream drying; hot stream: 90° C., 16.5 m/sec.; drying target: 5 kg/hr; drying time: 0.7 seconds
Primary dried product:

Water content: 0.1 wt. %; residual monomers: 680 ppm; sieve pass percentage: 95%
Secondary drying conditions: (the same as Example 10)
Secondary dried product:

Residual monomers: 70 ppm; sieve pass percentage: 95%

Comparative Example 6

Drying target: (the same as Example 7)
Primary drying conditions: (the same as Example 7)
Primary dried product: (the same as Example 7)
Secondary drying: (none)

TABLE 2-continued

Comparative Example 7

Drying target: Wet colored polymer particles with a water content of 22 wt. %
Primary drying conditions:

Fluidized bed drying; air: 50° C., 0.4 m/sec.; drying time: 4 hours
Primary dried product:

Water content: 0.1 wt. %; residual monomers: 180 ppm (310 ppm in deposit); sieve pass percentage: 85%
Secondary drying: (none)

Comparative Example 8

Drying target: (the same as Comparative Example 7)
Primary drying: (none)
Secondary drying conditions:

Vacuum drying; heating temperature: 50° C.; degree of vacuum: 2–5 kPa; drying time: 4 hours
Secondary dried product:

Residual monomers: 290 ppm; sieve pass percentage: 75%; water content: 0.3 wt. %

Comparative Example 9

Drying target & primary drying: (the same as Comparative Example 10)
Secondary drying: (none)

What is claimed is:

1. A process for producing a toner, comprising the steps of;

polymerizing a polymerizable monomer composition containing at least a polymerizable monomer and a colorant, in an aqueous dispersion medium to form colored polymer particles, and thereafter washing the colored polymer particles, followed by dewatering to prepare wet colored polymer particles;

subjecting the resultant wet colored polymer particles to substantial removal of the water held by the wet colored polymer particles, by means of a dryer making use of hot air to obtain toner particles; and drying the toner particles under reduced pressure by means of a vacuum dryer so that polymerizable monomers remaining in the toner particles come to be in a residue of 200 ppm or less.

2. The process according to claim 1, wherein said dryer making use of hot air is a dryer which dries the wet colored polymer particles while suspending them and forming a fluidized bed.

3. The process according to claim 2, wherein said wet colored polymer particles are dried by means of the dryer making use of hot air, until their water content comes to be from 0.1 to 0.5% by weight.

4. The process according to claim 2, wherein said wet colored polymer particles are dried by means of the dryer making use of hot air, until their water content comes to be from 0.1 to 0.3% by weight.

5. The process according to claim 1, wherein said dryer making use of hot air is a dryer which dries the wet colored polymer particles while dispersing it in the form of powder particles in a hot air stream and forwarding them in parallel to the hot air stream.

6. The process according to claim 5, wherein said wet colored polymer particles are dried by means of the dryer making use of hot air, until their water content comes to be from 0.1 to 0.5% by weight.

7. The process according to claim 5, wherein said wet colored polymer particles are dried by means of the dryer making use of hot air, until their water content comes to be from 0.1 to 0.3% by weight.

8. The process according to claim 1, wherein the step of drying the toner particles under reduced pressure by means of a vacuum dryer is carried out while feeding a gas into the dryer.

9. The process according to claim 1, wherein the step of drying the toner particles under reduced pressure by means of a vacuum dryer is carried out while feeding a gas into the dryer in a quantity for maintaining the dryer internal pressure to 13 kPa or below.

10. The process according to claim 1, wherein said toner particles are dried under reduced pressure by means of the vacuum dryer so that the polymerizable monomers remaining in the toner particles come to be in a residue of 150 ppm or less.

11. The process according to claim 1, wherein said toner particles are dried under reduced pressure by means of the vacuum dryer so that the polymerizable monomers remaining in the toner particles come to be in a residue of 100 ppm or less.

12. The process according to claim 1, wherein said toner particles contain a low-softening substance in an amount of from 5% by weight to 40% by weight, and the low-softening substance is encapsulated with a shell resin layer.

13. The process according to claim 12, wherein said low-softening substance is an ester wax having at least one long-chain alkyl group having 10 or more carbon atoms.

14. A process for producing a toner, comprising the steps of;

polymerizing a polymerizable monomer composition containing at least a polymerizable monomer and a colorant, in an aqueous dispersion medium to form colored polymer particles, and thereafter washing the colored polymer particles to prepare a slurry containing wet colored polymer particles;

subjecting the slurry containing wet colored polymer particles to substantial removal of the water held therein, by means of a dryer making use of hot air to obtain toner particles; and drying the toner particles under reduced pressure by means of a vacuum dryer so that polymerizable monomers remaining in the toner particles come to be in a residue of 200 ppm or less.

15. The process according to claim 14, wherein said dryer making use of hot air is a dryer which dries the slurry containing wet colored polymer particles while dispersing it in the form of powder particles in a hot air stream and forwarding them in parallel to the hot air stream.

16. The process according to claim 15, wherein the wet colored polymer particles are dried by means of the dryer making use of hot air, until their water content comes to be from 0.1 to 0.5% by weight.

17. The process according to claim 15, wherein the wet colored polymer particles are dried by means of the dryer making use of hot air, until their water content comes to be from 0.1 to 0.3% by weight.

18. The process according to claim 14, wherein the step of drying the toner particles under reduced pressure by means of a vacuum dryer is carried out while feeding a gas into the dryer.

19. The process according to claim 14, wherein the step of drying the toner particles under reduced pressure by means of a vacuum dryer is carried out while feeding a gas into the dryer in a quantity for maintaining the dryer internal pressure to 13 kPa or below.

20. The process according to claim 14, wherein said toner particles are dried under reduced pressure by means of the vacuum dryer so that the polymerizable monomers remaining in the toner particles come to be in a residue of 150 ppm or less.

21. The process according to claim 14, wherein said toner particles are dried under reduced pressure by means of the vacuum dryer so that the polymerizable monomers remaining in the toner particles come to be in a residue of 100 ppm or less.

22. The process according to claim 14, wherein said toner particles contain a low-softening substance in an amount of from 5% by weight to 40% by weight, and the low-softening substance is encapsulated with a shell resin layer.

23. The process according to claim 22, wherein said low-softening substance is an ester wax having at least one long-chain alkyl group having 10 or more carbon atoms.

* * * * *

UNITED STATES PATENT AND TRADEMARK OFFICE

CERTIFICATE OF CORRECTION

PATENT NO. : 6,207,339 B1
DATED : March 27, 2001
INVENTOR(S) : Masayoshi Kato et al.

It is certified that error appears in the above-identified patent and that said Letters Patent is hereby corrected as shown below:

Title page,
Item [57] ABSTRACT, line 1, "of," should read -- of --.

Column 1,
Line 39, "speed," should read -- speed, and --.

Column 2,
Line 27, "increases" should read -- increase --;
Line 28, "progresses" should read -- progresses, --;
Line 61, "increases;" should read -- increase; --.

Column 4,
Line 22, "in a good" should be deleted;
Line 23, "efficiency" should read -- efficiently --;
Line 32, "of;" should read -- of: --;
Line 49, "of;" should read -- of: --.

Column 5,
Line 26, "in a good" should be deleted;
Line 27, "efficiency" should read -- efficiently --.

Column 6,
Line 39, "chambers" should read -- chamber --.

Column 7,
Line 49, "(vacuum" should read -- (vacuum) --.

Column 8,
Line 9, "in a good efficiency" should read -- efficiently --.

Column 9,
Line 11, "in a good efficiency." should read -- efficiently. -- ;
Line 16, "back" should read -- bag --;
Line 24, "in a good efficiency." should read -- efficiently. --;
Line 32, "in a good efficiency" should read -- efficiently --;
Line 35, "on" should read -- of --;
Line 60, "greatly" should read -- greatly to occur --.

UNITED STATES PATENT AND TRADEMARK OFFICE

CERTIFICATE OF CORRECTION

PATENT NO. : 6,207,339 B1
DATED : March 27, 2001
INVENTOR(S) : Masayoshi Kato et al.

It is certified that error appears in the above-identified patent and that said Letters Patent is hereby corrected as shown below:

Column 10,
Line 29, "he" should read -- the --.

Column 11,
Line 37, "fixing" should read -- the fixing --.

Column 14,
Line 11, "colorant" should read -- colorants --;
Line 20, "colorant." should read -- colorants. --;
Line 38, "agent" should read -- agents --; and "a" should read -- an --;
Line 64, "a little vary" should read -- vary a little --.

Column 15,
Line 44, "acton" should read -- action --.

Column 17,
Line 11, "number" should read -- speed --;
Line 63, "in" should read -- in a --.

Column 19,
Line 22, "number" should read -- speed --;
Line 44, "facing to each other" should read -- (facing each other) --;
Line 51, "chamber 78" should read -- chamber 74 --.

Column 21,
Line 44, "500th" should read -- 500 --.

Column 23,
Line 26, "number" should read -- speed --.

Column 24,
Line 9, "in" should read -- in a --.

Column 25,
Line 26, "in" (third occurrence) should read -- in a --.

UNITED STATES PATENT AND TRADEMARK OFFICE

CERTIFICATE OF CORRECTION

PATENT NO. : 6,207,339 B1
DATED : March 27, 2001
INVENTOR(S) : Masayoshi Kato et al.

It is certified that error appears in the above-identified patent and that said Letters Patent is hereby corrected as shown below:

Column 28,
Table 1, "Remarks" should read -- Remarks
(1)
(1)
(1)
(1)
(1)
(1)
(2)
(3)
(4)
(3)
(5) --.

Column 31,
Line 28, "of;" should read -- of: --;
Line 57, "it" should read -- them --.

Column 32,
Line 52, "of;" should read -- of: --.

Signed and Sealed this

Twenty-first Day of May, 2002

*Attest:*

*Attesting Officer*

JAMES E. ROGAN
*Director of the United States Patent and Trademark Office*